US012623755B2

(12) United States Patent
Tan

(10) Patent No.: US 12,623,755 B2
(45) Date of Patent: May 12, 2026

(54) FLOATING PLATFORM FOR RENEWABLE ENERGY

(71) Applicant: G8 ENERGY PTE LTD, Singapore (SG)

(72) Inventor: Tze Liong Tan, Singapore (SG)

(73) Assignee: G8 ENERGY PTE LTD, Singapore (SG)

( * ) Notice: Subject to any disclaimer, the term of this patent is extended or adjusted under 35 U.S.C. 154(b) by 460 days.

(21) Appl. No.: 18/251,885

(22) PCT Filed: Nov. 21, 2020

(86) PCT No.: PCT/SG2020/050683

§ 371 (c)(1),
(2) Date: May 5, 2023

(87) PCT Pub. No.: WO2022/108518

PCT Pub. Date: May 27, 2022

(65) Prior Publication Data

US 2024/0010309 A1 Jan. 11, 2024

(51) Int. Cl.
*B63B 35/44* (2006.01)
*B63B 35/38* (2006.01)

(52) U.S. Cl.
CPC ..... *B63B 35/44* (2013.01); *B63B 35/38* (2013.01); *B63B 2035/4433* (2013.01); *B63B 2241/08* (2013.01)

(58) Field of Classification Search
CPC .. B63B 35/44; B63B 35/38; B63B 2035/4433
See application file for complete search history.

(56) References Cited

U.S. PATENT DOCUMENTS

2012/0292910 A1* 11/2012 Moore ..... B63B 35/44 290/53
2017/0363058 A1* 12/2017 Etherington ..... B63B 1/107

FOREIGN PATENT DOCUMENTS

JP 2020165381 A * 10/2020 ..... B63B 35/38
KR 101807998 B1 * 12/2017 ..... H02S 10/40
WO 2019102188 A1 5/2019
WO WO-2022108518 A1 * 5/2020 ..... B63B 35/38

OTHER PUBLICATIONS

International Search Report and Written Opinion of the corresponding PCT application No. PCT/SG2020/050683 mailed on Jul. 26, 2021.

* cited by examiner

*Primary Examiner* — S. Joseph Morano
*Assistant Examiner* — Jovon E Hayes
(74) *Attorney, Agent, or Firm* — Idea Intellectual Limited; Sam T. Yip

(57) ABSTRACT

The present application relates to a floating module, a floating platform assembled by multiple floating platforms, and an offshore system assembled by multiple floating platforms for harvesting green energies in a large body of water. The floating module comprises an external frame having a plurality of side tubes for providing buoyance to the floating module; and an internal frame coupled to the external frame. In addition, the floating module has a mooring mechanism for fixing the floating module in position at sea or ocean. Methods of making the floating module and assembling the floating platform and the offshore system are also disclosed.

27 Claims, 13 Drawing Sheets

(a)

(b)

(a)

(b)

FLOATING PLATFORM FOR RENEWABLE ENERGY

The present application relates to a floating module, a floating platform assembled by multiple floating modules, and an offshore system assembled by multipole floating platforms for harvesting green energies in a large body of water. The present application further relates to a method of making the floating module, and methods of assembling the floating platform and the offshore system.

Traditional facilities for harvesting green energies or renewable energy (such as solar energy) are built on land for easy construction and maintenance. However, the facilities would occupy large areas of land and thus are not suitable for small countries (such as Singapore) or inside large cities (such as London) where land is in a very limited supply. Floating platforms are then developed for installing the facilities on inland small bodies of water, such as lakes, reservoirs, storage ponds, clearing pools. However, large-scaled facilities cannot be installed on the small bodies of water. In addition, the facilities may also cause environmental problems (such as invading living space of wild animals) around the small bodies of water and meanwhile deteriorated thereby.

Recently, floating platforms are construed on shallow bodies of water at or near coastlines of large water bodies (such as seas and oceans) as extensions from onshore lands. However, the floating platforms still cannot be built in large scales on the shallow bodies of water where other facilities (such as fishing farms, goods harbors and recreational facilities (such as surfing)) are also located. In addition, green energies other than solar energy (such as wind energy and ocean energy) does not exist in a substantial mount at or near the coastlines. Therefore, there is a need for a floating platform that can be built and maintained on the large bodies of water far away from the coastlines for harvesting various types of green energies.

As a first aspect, the present application discloses a floating module. The floating module comprises an external frame having a plurality of side tubes for providing buoyance to the floating module; and an internal frame coupled to the external frame. A facility (particularly renewable energy facility (such as solar cell)) is configured to mount on the internal frame. Preferably, the side tubes are identical such that the floating module has a symmetrical configuration. The side tubes have a hollow structure with an outer diameter ranging from 200 millimeters (mm) to 1000 millimeters (mm) and a thickness ranging from 9 millimeters (mm) to 50 millimeters (mm). In some implementations, the external frame has a hexagonal configuration assembled by six identical side tubes; and the floating module is called hexagonal floating module accordingly. Each side tube has a length ranging from 6 meters (m) to 30 meters (m) and thus the hexagonal floating module has an area defined by the external frame defines an area in a range of 90 square meters ($m^2$) to 2330 square meters ($m^2$). For harvesting green energies at the sea or ocean, one or more facilities (such as solar panels or wind turbines) are configured to mount on the internal frame for collecting the green energies of various types that are available at the sea or ocean.

Two or more of the side tubes (such as six side tubes for the hexagonal floating module) are hermitically joined (by welding such as thermal fusing or by elbow) for preventing leakage into the external frame. The side tubes are optionally made of light-weight materials which does not soak water. Since the floating platform is installed in seas and oceans, the light-weight materials should have resistance to the harsh marine conditions, including but not limited to corrosion of saline sea water, extensive UV-exposure and severe interferences of marine livings. In addition, the side tubes should have significant mechanical strength for resisting shocks of storms and flow of ocean currents. Since temperature changes significantly in daytime and nighttime in the oceans, the light-weight materials optionally have a low thermal efficient for maintaining the floating module. In some implementations, the side tubes are made of engineering plastics, including thermal plastic materials such as High Density Poly Ethylene (HDPE), Ultra High Molecular Weight Polyethylene (UHMWPE), PerFluoroAlkoxy (PFA), PolyFluoroEth, Cross Link PE (XLPE), Polypropylene (PP) (such as PP Random (PPR)), PolyTetraFluoroEthylene (PTFE), EthyleneChloroTrifFluoroEthylene, PolyVinyliDeneFluoride (PVDF), Fluorinated Ethylene Propylene (FEP) and Perfluoroalkoxy Alkanes (PFA); as well as thermoset materials such as EthyleneVinylalcOHol (EVOH), PolyVinylChoride (PVC), PolyStyrene (PS), PolyCarbonate (PC), PolyMethylMethAcrylate (PMMA) and Acrylonitrile Butadiene Styrene (ABS). In some implantations, the side tubes are made of composite materials such as fiberglass reinforced polymers (FRP), or new carbon materials such as carbon fibers, three-dimensional graphene, exotic forms of carbon (such as carbyne and aerographite), graphene aerogel or aerographene, as well as foamed cements. In some implementations, the side tubes are made of aircraft meals such as titanium alloys and metallic micro lattice of nickel phosphorous tubes. It is understood any known light-weight materials suitable for the harsh marine conditions can be applicable to the side tubes. On applications having much larger sizes or when greater structural rigidity is required, i.e. mounting a wind turbine structure on assembled floating modules, marine grade steel tubes may be welded together to construct the assembled floating modules.

The side tubes are optionally hermetically sealed for preventing sea water from entering into the hollow structure. In some implementations, two discs are joined to two ends of each side tube respectively by any known joining method depending on the materials of the side tube and the discs. For example, the joining method may be shielded metal arc welding (SMAW), gas tungsten arc welding (GTAW), gas metal arc welding (GMAW), submerged arc welding (SAW), ultrasonic welding, laser welding, friction stir welding, or friction spot welding if the side tube and the discs are made of metal materials. For another example, the joining method includes an external heating method or an internal heating method if the side tubes and the discs are made of polymers, polymeric materials or polymeric composite materials. The external heating method include but not limited to hot-gas welding, hot wedge welding, extrusion welding, hot plate welding, infrared (IR) welding and laser welding; and the internal heating method includes mechanical ways including spin welding, stir welding, vibration welding (i.e. friction welding) and ultrasonic welding; and electromagnetic ways including resistance welding (also known as implant welding or electrofusion welding), induction welding, dielectric welding and microwave welding.

In some implementations, two stoppers are used for hermetically sealing the side tube. The stoppers may have a size just slightly smaller than the inner diameter of the side tube so that the stoppers are inserted tightly and thus hermetically into the two ends of the side tube, respectively. Alternatively, the stoppers may have a size just slightly larger than the outer diameter of the side tube so that the two ends of the side tubes are inserted tightly and thus hermetically into the two stoppers, respectively. In addition, the stoppers may be further secured to the side tubes by any known method (such as the joining methods described above for the side tubes) depending on materials of the stopper and the side tube.

The side tubes are preferably hermetically sealed individually. If one side tube is damaged with water filled into its hollow structure, the five side tubes remaining intact can still provide enough buoyance to the floating module and the facility mounted thereon. The damaged side tube may be easily replaced with a new side tube either on-site at the sea or off-site on land after dragging the floating module onshore. In some implementations, the side tube has a plurality of baffles for separating the hollow structure into multiple sections. If one section is punctured, the water filled inside would be confined to the section and the side tube as a whole can still floating on the sea.

The internal frame optionally has a H-shaped configuration having a first bar and a second bar coupled to the external frame; and a panel coupled to the first bar and the second bar. In particular, the first bar and the second bar have a same or substantially same length and are configured to be parallel or substantially parallel to each other. In other words, the internal frame is located at a central position of the external frame and thus the floating module has a symmetrical shape which are easily assembled with each other. The first bar and the second bar are optionally made of the light-weight but mechanically strong materials as described for the side tubes. Preferably, the first bar and the second bar are made of the same material as the side tubes for easy coupling of the internal frame to the external frame.

The facility (such as solar panel or wind turbine) is optionally mounted on the panel; and thus the panel optionally has a symmetrical shape across an imaginary center of the floating module for evenly distributing weight of the facility to the floating module. In some implementations, the panel has a rectangular shape vertical to the first bar and the second bar and thus has a length substantially the same as the side tube. In some implementations, the panel also has a hexagonal shape in accordance with the external frame. The panel is made of mechanically rigid structural materials which would not undergo deformation under the weight of the facility, including but not limited to iron materials (such as wrought iron, cast iron, steel, stainless steel), concrete materials (such as reinforced concrete and pre-stressed concrete), composite materials (such as glass-reinforced plastics) and timbers.

The external frame is optionally not completely covered by the external frame for leaving one or more blank areas through the external frame. Through the blank areas, water can flow either downwardly to or upwardly from the sea. On one hand, rain water falling on the facility can be dissipated through the black areas to the sea for mitigating corrosions caused by accumulated water. On the other hand, tide is a common phenomenon in the sea where water rises and falls; and may cause shocks and vibrations to the floating module against the sea water. In presence of the black areas, sea water of the tide can rise and fall through the floating module which significantly reduces the shocks and vibrations to the floating module. Therefore, the facility is likely to be mechanically damaged by the shocks and vibrations. Preferably, the black areas are symmetrically distributed to the imaginary center of the floating module for balancing the facility on the floating module.

The floating module may further comprise a mooring mechanism coupled to the external frame or internal frame for fixing the floating module in position. The traditional mooring mechanisms usually have one, two or at most three fixtures to the floating module. Since the fixing force is confined to positions where the fixtures are located, parts of the floating module at the positions are more likely to be damaged which would cause the floating module to fail in a shorter lifespan. In contrast, the mooring mechanism of the application provides a plurality of fixtures (such as six fixtures for the hexagonal floating module) to the floating module, depending on the shape of the floating module. In addition, the fixtures of the mooring mechanism are optionally secured symmetrically to the floating module for providing a balanced fixing force. For the hexagonal floating module, the mooring system may have six fixtures secured to six middle points of the six side tubes, respectively. Alternatively, the mooring system may have six fixtures secured to six cross-points of the six side tubes, respectively. Alternatively, the mooring system may have twelve fixtures secured to both the six middle points and the six cross-points of the six side tubes, respectively, which distributed the fixing force more evenly around the hexagonal floating module.

The mooring mechanism optionally comprises at least one string coupled to the external frame at a first end; and a sinker coupled to the at least one string at a second end opposed to the first end. The sinker has an anchoring ability for fixing the floating module at a specific location on the sea. The traditional mooring system may have a string secured at one end to the conventional floating module which is construed on shallow bodies of water at or near coastlines of large water bodies; and secured to onshore anchors for fixing the conventional floating module relative to the onshore anchor. Therefore, the conventional floating module cannot be constructed at the sea far away from the coastline. In addition to the string, the traditional mooring system may also have a sinker for fixing the conventional floating module near the coastline. However, the sinker is rested on beds beneath the shallow bodies of water near the coastlines; and the string is in a slack state. As a result, the conventional floating module would move either laterally or vertically with the water until the string is pulled into a tension state. In contrast, the string of the mooring mechanism of the application is always in the tension state since the sinker is not rested on sea beds but is suspending in the sea water under the sea. therefore, the floating module of the application can be advantageously fixed in position more firmly than the conventional floating modules.

The sinker is submerged under the sea and thus has to be resistance to corrosions of the saline sea water. The sinker is also optionally made of materials having a large density for easy handling and transportation. Exemplary materials include but are not limited to sands, stones, rocks, lead, steel, brass, bismuth, tungsten and high-density-composite-resins.

The at least one string comprises a plurality of branch strings (such as six branch strings for the hexagonal floating module) secured to different positions (such as the six cross-points of the hexagonal floating module) of the external frame at first ends respectively and secured to the sinker at second ends opposed to the first ends. Preferably, the branch strings are distributed in a symmetrical manner, such as the middle points or the cross-points of the side tubes. The even and balanced distribution of the fixing force would enhance stability of the floating module at the sea. The branch strings may be made of an elastic material such as rubber materials, including but not limited to natural rubber, synthetic rubber, nitrile rubber, silicone rubber, urethane rubber, chloroprene rubber, ethylene-vinyl-acetate (EVA) rubber; as well as quartz fibers. For example, the branch string is made of an elastic rubber hose for holding a loading of about 200 kilogram (kg) due to its excellent stretch capability (i.e. stretchability). If having multiple elastic rubber hoses, the branch string would hold a loading of around 1000 kilogram (kg). The elastic branch strings under constant tensions with no slack would also enhance stability of the floating module at the sea. Therefore, the mooring mechanism of the application can make the floating module adaptable to various harsh offshore conditions with the evenly distributed elastic branch strings.

The at least one string optionally further comprises a trunk string for coupling the branch strings (such as the six branch strings for the hexagonal floating module) and the sinker. The trunk string may be also made of the elastic materials as the branch strings for further stabilizing the floating module at the sea. The trunk string may be implemented in different designs. For example, the trunk string as an independent component is tied to the branch string at an upper end and tied to the sinker at a lower end. For example, the trunk string is formed by bundling lower portions of the branch strings into a single component coupled to the sinker; while upper portions of the branch strings are secured to the anchoring points of the external frame, respectively.

The mooring mechanism optionally has a float, floater or buoy coupled to an end of the at least one string (including the branch strings and the trunk string) such that the mooring mechanism floats by itself on the water of the sear or ocean even before being coupled to the floating module. The mooring mechanism is thus easy to be seen and found on the sea or ocean at or near an assembly location. As a result, the mooring mechanism may be firstly transported to the assembly location at the sea or ocean separately from the floating module; then kept floating on the water; and finally assembled with the floating module. In addition, if the floating module breaks, the mooring mechanism would be decoupled from the broken floating module and still kept floating on the water; and thus the mooring mechanism can be easily found and then assembled with a new floating module.

The mooring mechanism may further comprise a shock absorber (also known as damper) coupled to the at least one string for shocks to the floating module on the sea. For example, the damping mechanism is coupled to the trunk string below the branch strings but above the sinker for the floating module. The shock absorber converts kinetic energy brought by the shocks into another form of energy (such as thermal energy or heat) which is dissipated from the floating module without causing any influence or damage. The shock absorber may have various designs. In some implantations, the shock absorber has one or more dashpots which resist the shocks via viscous friction. In some implementations, the shock absorber has one or more springs for converting the kinetic energy into elastic potential energy stored in the springs. Exemplary shock absorber includes mono-tube, twin-tubes (such as basic twin-tube, gas cell two-tube, position sensitive damping (PSD) twin-tube, acceleration sensitive damping twin-tube and coilover), as well as spool valve.

The floating module is optionally configured to mount an electric generator or electricity generator (such as solar panel or wind turbine) for harvesting green or renewable energy (such as green energy). The renewable energy refers to energy from resources that rely on fuel sources that restore themselves over short periods of time and do not diminish. The fuel sources include the sun, wind, moving water, organic plant and waste material (eligible biomass), and the earth's heat (also known as geothermal energy). Although the impacts are small, some renewable energy technologies can have an impact on the environment. The electric generator is particularly used for harvesting green energy. The green energy is a subset of the renewable energy and particularly refers to those renewable energy resources and technologies that provide the highest environmental benefit, including solar energy, wind energy, wave energy, tidal energy and geothermal energy which is then converted into electrical energy. Preferably, the electric generator is mounted in a symmetrical manner to the floating module for balancing electrical generator on the floating module. For example, multiple solar panels are distributed around the imaginary center of the floating module. For another example, a wind turbine is mounted on the panel of the internal frame at the imaginary center of the floating module.

As a second aspect, the present application discloses a floating platform assembled by the floating modules as described in the first aspect. The floating platform comprises two or more floating modules flexibly joined together. The flexible joint allows the floating platform to deform at the joints within a certain range either upwardly or downwardly which would help the floating platform to be adapted to rise and fall of the sea water. The certain range depends how the joined floating module and may be +20 degrees to −20 degrees, +15 degrees to −15 degrees, +10 degrees to −10 degrees, or +5 degrees to −5 degrees. The positive direction and negative direction of the certain range refer to the upward deformation and the downward deformation, respectively.

In some implementations, the floating modules are joined by thermoplastic welding if they are all made of thermal plastic materials, and preferably a same thermal plastic material. The thermoplastic welding optionally applies a sealant between the floating modules; then heats the sealant above a certain temperature for joining the floating modules together; and finally cools down the sealant to an ambient temperature at the sea. The sealant is also made of thermal plastic materials, preferably the same thermal plastic material as the floating modules. The certain temperature depends on the specific thermal plastic material. The thermal plastic materials include but are not limited to High Density Poly Ethylene (HDPE), Ultra High Molecular Weight Polyethylene (UHMWPE), PerFluoroAlkoxy (PFA), PolyFluoroEth, Cross Link PE (XLPE), Polypropylene (PP) (such as PP Random (PPR)), PolyTetraFluoroEthylene (PTFE), EthyleneChloroTrifFluoroEthylene, PolyVinyliDeneFluoride (PVDF), Fluorinated Ethylene Propylene (FEP) and Perfluoroalkoxy Alkanes (PFA). It is tested that the joints between the floating made by the thermal plastic welding have a higher strength than the side tubes of the floating modules.

The thermoplastic welding may use various means to melt the sealant to the floating modules, including but is not limited to a mechanical welding means, a thermal welding means, an electromagnetic welding means, or a chemical welding means (also known as solvent welding). The mechanical means includes but not limited to ultrasonic welding (20-40 kHz), stir welding (1-100 Hz), vibration welding (100-250 Hz) and spin welding (1-100 Hz). The electromagnetic welding means includes but is not limited to induction welding (5-25 MHz), microwave welding (1-100 GHz), dielectric welding (1-100 MHz) and resistance, implant or electrofusion. The thermal welding means includes but is not limited to hot gas welding (such as tack welding and rod welding), extrusion welding, infrared welding, laser welding, hot wedge welding and hot plate or butt fusion welding. In addition, the thermoplastic welding is examined by using various methods for testing welding integrity. The methods include but are not limited to creep test (such as creep rupture test and tensile creep test), impact test, shear test, peel test (BS EN 12814-4), bend test (DVS 2203-1 and DVS), tensile test (DVS 2203-5) and hydrostatic pressure test (ASTM). For example, the thermoplastic welding is examined by a non-destructive test (NDT) for ensuring a welding quality of the bottom. The non-destructive test includes but is not limited to holiday spark test, ultrasonic test, leak-tightness test, radiography and visual inspection (DVS 2202-1). In particular, the non-destructive test comprises a holiday spark test for identifying unacceptable discontinuities such as pinholes, holidays, bare spots or thin points.

The floating platform may further comprises a plurality of dampers (such as damping matts) for flexibly coupling (such as binding, joining or interlocking) two neighboring side tubes of two adjacent floating modules, respectively. The damping matts with interlock mechanism are made of materials which can absorb vibrations or shocks effectively, such as HDPE, visco-elastic polymers and silicone to achieve flexible coupling. As a result, the damping matts would protect the floating platforms by absorbing external shocking or vibrational energy of the sea water to the floating modules. The damping matts may bind or interlock two adjacent floating modules by flexibly winding around the two neighboring side tubes of the two adjacent floating modules together, which allows the two neighboring side tubes to relatively rotate to each other and thus enables the two adjacent floating modules to move along with rise and fall of the sea water. The flexible binding further enhances stability and integrity of the assembled floating platform by adapting but not resisting the assembled floating platform to marine environment in the sea or ocean. In addition, fastening bands may also be used to bind the damping matts more securely to the side tubes. Exemplary fastening bands include metal (such as stainless steel) bands, fabrics bands and rubber bands. In particular, the fastening bands would not hinder the two bound neighboring side tubes to relatively rotate to each other.

The damping matts optionally have enough structural strength to server as a service walkway for bearing human or instruments to move on the damping matts. Since all the floating modules of the floating platform are bonded or interlocked by the damping matts, human or the instruments can get access to other floating modules from the preliminary harbor constructed at a specific floating module. The damping matts may be arranged in a continuous configuration along a length of the side tubes for making a continuous walkway between every two opposed cross-points of the floating platform. Alternatively, the damping matts are divided into sections with gaps there between. Water or other foreign substances (such as bird droppings) can be cleaned from the gaps. The gaps are optionally within a certain distance for human or the instruments to move without hindrance. The certain distance may be around 50 centimeters (cm), 40 centimeters (cm), 30 centimeters (cm), 20 centimeters (cm), 10 centimeters (cm) or 5 centimeters (cm), and preferably 30 centimeters (cm) since a step of an average human being is around 30 centimeters (cm). Therefore, the damping matts facilitate inspection and repair to every location of the floating platform after human or the instruments arrive at the preliminary harbor. If contaminated or damaged, the damping matt or the section of the damping matts can be repaired with a new replacement. The damping matts are optionally easily attached onto and detached from the side tubes without using any heavy tooling, and preferably manually handled. In addition, rails may be built at edges of the damping matts for not only protecting human or the instrument but also preventing marine animals from entering into the damping matts and further into the floating modules.

The floating platform may further comprise one or more bumpers, spacer or resilient separator (such as resilient separators or spacers) between two of the plurality of dampers (such as the damping matts) for preventing sliding of the dampers. For example, the bumpers or spacers are installed beneath the damping matts which would not hinder movement of human or the instruments on the damping matts. The bumpers or spaces are also made of energy absorbing materials such as fabrics, visco-elastic polymers and silicone; and preferably the same material as the damping matts. In this case, the bumpers and the spaces are more secured to the damping matts since they have a same thermal expansion coefficient of the same material.

The floating platform optionally has a symmetrical configuration by arranging one floating module at a central position (called central floating module) and other modules surrounding the central floating module at peripheral positions of the floating platform (called peripheral floating modules). In some implementations, the floating platform is assembled by seven hexagonal floating modules as described above. The floating platform comprises one hexagonal floating module at a central position (called central floating module) of the floating platform; and six peripheral floating modules (called peripheral floating modules) assembled surrounding the central floating module for forming a symmetrical pattern. In some implementations, the facilities for harvesting green energies are mounted on the central floating module only; while an auxiliary equipment (such as fences for protecting the floating platform and a temporary harbor for getting access to the floating platform) on the peripheral floating modules. In some implementations, the facilities for harvesting green energies are mounted both on the central floating module and the peripheral floating modules.

The floating platform may further comprise the mooring mechanism as described above for fixing the floating platform in a predetermined location at the sea. The mooring mechanism may be coupled to the floating platform in various designs. For example, the mooring mechanism is coupled to the floating module at the central position (i.e. central floating module) only, one or more peripheral floating modules only, or both the central floating module and the peripheral floating modules.

In some implementations, the mooring mechanism comprises a central sinker coupled underneath to the central floating module. The sinker of the mooring mechanism has a weight heavy enough for also fixing the six peripheral floating modules of the floating platform. Due to the flexible joints between the hexagonal floating modules as described above, the peripheral floating modules would slightly deform upwardly relatively to the central floating module within the certain range as described above for distributing the fixing force across the floating platform; and thus the mooring mechanism coupled to the central floating module would not cause internal tension in the floating platform.

In some implementations, the mooring mechanism comprises a plurality of peripheral sinkers coupled underneath one or more peripheral floating modules respectively. The peripheral sinkers are preferably distributed in a symmetrical configuration to the central floating module. For example, six identical mooring mechanisms are coupled to the six peripheral floating modules, respectively. Since surrounded by the peripheral floating modules, the central floating module and thus the floating platform are also fixed at the sea. Similarly, no internal tension is caused across the floating platform since the central floating module can slightly move upwardly relatively to the peripheral floating modules.

In some implementations, if the floating platform is deployed at the sea where large storms are often present, both the central sinker and the peripheral sinkers are coupled underneath the central floating module and the six peripheral floating modules, respectively. Since seven the mooring mechanisms are evenly distributed, no internal tension would be generated across the floating platform. In contrast, if resisting the large storms at the sea by increasing the weight(s) of the central sinker or the peripheral sinkers in the implementations described above, the central floating module and the peripheral floating modules may move relatively to each other beyond the certain range, which would damage or even destroy integrity of the floating platform.

The floating platform may further comprise an energy storage device for temporarily storing generated green energies (such as solar energy or wind energy). The energy storage device may include any device which can store and then discharge energies in various forms such as electrochemical, kinetic, pressure, potential, electromagnetic, chemical, and thermal. Exemplary energy storage devices include fuel cells, batteries, capacitors, flywheels, compressed air, pumped hydro, super magnets, and hydrogen. Preferably, the green energies are converted into electrical energies and stored into electrical energy storage devices, including but is not limited to lead-acid battery, lithium-ion battery, capacitor and lithium-ion capacitor. In addition, the energy storage device is enclosed inside an external case which is not only hermitical to water and moisture, but also resistance to erosions, vibrations and shocks.

The floating platform may further comprise a canopy for covering the floating platform partially or wholly as protection for protecting the floating platform. In particular, the canopy covers the facilities for harvesting green energies and the energy storage device. For example, the canopy is openable in day time for solar panels to harvest the solar energy; and closable in nigh time, cloudy day and raining day when the solar energy is not available. Preferably, the closed canopy isolates the solar panels from the surrounding environment for preventing corrosion and contamination from the sea.

As a third aspect, the present application discloses an offshore system for harvesting renewable energy (particularly green energy) in a large water body (such as seas and oceans). The offshore system comprises a plurality of the floating platforms as described in the second aspect; and particularly the floating platforms are flexibly joined together to form the offshore system in a large scale.

The plurality of floating platforms are configured to form one or more small bodies of water inside the floating system communicative with the large water body. The small bodies on one hand discharges water from the offshore system into the sea or ocean; and on the other hand stabilizes the offshore system when the sea rises and falls with waves from time to time. In other words, the offshore system can remain at a relatively stable level regardless of the rise and fall of the sea waves. In addition, the small bodies of water can also be used to store new facilities (such as solar panels or wind turbines) for replacing damaged facilities such that the new facilities can be replace in time with low costs. Furthermore, fresh water may be stored in the small bodies from rain water for multiple purposes such as cooling the solar panels and preparing cleaning solution to clean the offshore system.

Various facilities may be utilized for harvesting any available green energies at the sea or ocean. In some implantations, the offshore system comprises a plurality of solar panels mounted on the floating platforms respectively for harvesting and converting solar energy to electrical energy. The solar panels are connected in series and then encapsulated into a protector (such as glass panels) transparent to sunlight. Compared with the traditional facilities with the solar panels mounted on the land, the offshore system has a much higher efficiency in harvesting the solar energy since the solar panels are cooled by the sea water. The efficiency is usually enhanced by 5% to 10%, depending on a temperature of the sea water. In addition, much less air pollutants (such as dust and corrosive gases) exist at the sea and thus the solar panels of the offshore system can be maintained with lower costs. In order to further maximize harvest of the solar energy, a tracking device may be also installed under the solar panels for tracking the solar panels always toward the sun in the daytime. For example, the tracking device has a rotating apparatus (such as a ball bearing) for rotating the solar panels laterally and an adjusting apparatus for adjusting titling angles of the solar panels. For another example, the tracking device has a scrolling apparatus for rotating the solar panels freely in three-dimensional (3D) space. The tracking device is controlled via an algorithm stored in a computing device for precisely controlling the movement of the solar panels towards the sun. The solar energy typically has a power density around 1 kilowatt per square meters (kW/m 2) at peak solar insolation at the sea.

In some implantations, the offshore system comprises a plurality of wind turbines mounted on the floating platforms respectively for harvesting and converting wind energy to electrical energy. The wind turbines can be mounted in various configurations on the offshore system. Exemplary configurations include a Spar-configuration and mounted onto the floating frame. Implantations of The Spar-configuration may have a small footprint by using monopole foundation mounted on the panel of the internal frame of the floating module, a larger footprint by using gravity foundation mounted on the internal frame (including the panel and the first and second bars) or by using tripod/truss foundation mounted on the external frame of the floating module. Other configurations include tension-leg-platform (TLP) configuration as well as semi-sub configuration. In addition, the wind turbines may be installed together with the solar panels in the offshore system. The wind energy has a compared energy density with the solar energy, around 1 kilowatt per square meters (kW/m$^2$) at a speed of 12 meters per second (m/s).

The offshore system optionally comprises a plurality of wave energy converters (WECs) mounted on the floating platforms respectively for harvesting wave energy to electrical energy. Waves gain energy from wind as long as the wind propagates faster than the waves. Due to strong winds at the sea or ocean, a plenty of wave energy also exists there. Therefore, the wave energy converters (WECs) may be installed individually, but preferably together with the wind turbines for harvesting more energies. The wave energy converters (WECs) may be any device that undergoes the following principle of collecting and converting the wave energy into electrical energy: firstly, gathering the waves with various methods such as resonance; then converting the wave energy along with the collected waves into mechanical energy such as mechanical transmission, low-pressure hydraulic energy, high-pressure hydraulic transmission and pneumatic transmission; and finally converting the mechanical energy into electrical energy via electrical generator. In addition to the wind turbines, the wave energy converters (WECs) may also installed together with the solar panels since the wave energy converters (WECs) are installed at peripheries of the offshore system for receiving and gathering waves. The wave energy has a much higher energy density than the solar energy or the wind energy, typically around 25 kilowatts per square meters ($kW/m^2$).

The offshore system optionally comprises a plurality of hydrokinetic turbines mounted on the floating platforms respectively for harvesting and converting tidal energy to electrical energy. Tides are more predictable than the wind and the sun, and thus tidal energy can be harvested in a more anticipated manner. Exemplary hydrokinetic turbine includes tidal stream generator, tidal barrage, dynamic tidal power and tidal lagoon. The hydrokinetic turbines are preferably installed at peripheries of the offshore system for receiving incoming sea water. Due to frequent contact with a large amount of the saline sea water, the hydrokinetic turbines are preferably made of corrosion-resistant materials such as stainless steels, high-nickel alloys, copper-nickel alloys, nickel-copper alloys and titanium. In addition, marine organism may grow rapidly at the hydrokinetic turbines at the sea due to high tidal currents and high biological productivity; and thus a cleaning apparatus may be installed at the hydrokinetic turbine for reducing fouling.

For harvesting the solar energy, the solar panels work in conjunction with some electrical components in a photovoltaic architecture. In some implementations, the offshore system optionally further comprises one or more combiner boxes for combining or collecting the electrical energy from the solar panels. The solar panels are interconnected with solar cables or solar strings for transporting the electrical energy converted from the solar energy. The solar cables or solar strings are converged at the combiner box for bring outputs of the solar cables or solar strings together. Two or more of the combiner boxes may be distributed around the photovoltaic architecture for avoiding extending the solar cables or solar strings across the offshore system.

The offshore system optionally further comprises a central inverter for changing electricity of direct current (DC) to alternating current (AC). The central inverted may comprises a DC box, a converter and an AC box connected in series. The electrical energy coming out of the one or more combiner boxes is in the form of direct current (DC) which is firstly converged into the DC box, then converted to direct current (DC) in the converter, and finally flows through the DC box to a supply point such as a power grid or buildings. In addition, the direct current (DC) usually exist in a form of low voltage due to a limited number of solar panels connected in series for a single solar cable or solar string.

The offshore system optionally further comprises a transformer for transmitting and interconnecting the Alternative Current (AC) with a power grid which is located far away from the offshore system. It is well-known that direct current of high voltage would have less loss for long-distance transmission; and thus the transformer is used to transform the direct current (DC) of low voltage into direct current of high voltage before long-distance transmission.

The offshore optionally further comprises a dock for loading and unloading the offshore system with a ship. The ship carries staffs and materials for maintaining operation of the offshore system. The dock may have a small profile which can be built directly in connection with the floating platforms. Alternatively, the dock may be built independently and connected to the floating platforms via a floating bridge if the dock has a large profile.

As a fourth aspect, the present application discloses a method of making the floating module as described in the first aspect. The method of making comprises a step of flexibly coupling the multiple (such as six) side tubes in an end-to-end configuration in sequence for forming an external frame having a hexagonal shape; and coupling an internal frame to the external frame in a H-shaped or H-profiled configuration.

The step of coupling an internal frame may comprise a step of joining a first bar to two opposed ends of the external frame, respectively; a step of joining a second bar to another two opposed ends of the external frame, wherein the first bar and the second bar are configured to be parallel; and a step of joining a panel to the first bar and the second bar.

Alternatively, the coupling the internal frame may comprise a step of positioning a first bar and a second bar to be substantially parallel to each other; a step of joining a panel to the first panel and the second panel for forming the internal frame; and a step of joining the first bar and the second bar to two opposite ends of the external frame, respectively.

The method of making the floating module may further comprise a step of coupling a mooring mechanism to the external frame. As described above in the first aspect, the mooring mechanism may have various designs and the step of coupling the mooring mechanism depends on the designs of the mooring mechanism accordingly. It is understood to skill persons that the any method of coupling the mooring mechanism is within this application if the method does not deviate from the inventive concept.

In some implementations, the step of coupling a mooring mechanism comprises a step of tying multiple (such as six) branch strings to multiple (such as six) end points of the external frame, respectively; a step of typing the multiple (such as six) branch strings to a trunk string; and a step of coupling a sinker to the trunk string away from the multiple (such as six) branch strings.

In some implementations, the step of coupling a mooring mechanism comprise a step of tying upper portions of multiple (such as six) branch strings to multiple (such as six) end points of the external frame, respectively; a step of combining lower portions of the multiple (such as six) branch strings into a trunk string; and a step of coupling a sinker to the trunk string away from the upper portions of the multiple (such as six) branch strings.

The step of coupling a mooring mechanism optionally further comprises coupling a damping component (also known as damper) to the trunk branch. The damping component includes devices for surface level damping and subsea level damping. For example, the damping matts as described in the second aspect integrates multiple floating modules into the floating platform for the surface level damping. For another example, the shock absorber as descried in the first aspect applies a pulling tension to the mooring mechanism for the subsea level damping. It is understood that preliminary steps may be taken before coupling the damping component, such as evaluating marine conditions (such as frequencies and wave conditions) and adjusting the damping components according to the evaluation.

The method of making the floating module may further comprise a step of hermetically sealing the multiple (such as six) side tubes (e.g. ends of the multiple side tubes) for sealing the hexagonal floating module, preferably water tight.

The method of making the floating module may further comprise a step of replacing a malfunctioned side tubes for maintaining buoyance of the hexagonal floating module.

The method of making the floating module may further comprise a step of installing a sensor at the external frame for monitoring failure of any of the multiple (such as six) side tubes. Exemplary sensors include an underwater camera for observing the side tubes submerged under the sea water; and an electrical contact switch mounted on the side tubes above the sea water. When the side tube is broken and sunk down, the electrical contact switch would be closed to trigger a warning signal after it is in contact with the sea water. It is also understood that level sagging of the side tubes is also an obvious sign of the breakage or leakage.

As a fifth aspect, the application discloses a method of assembling the floating platform from multiple floating modules as described in the first aspect. The method of assembling comprises a step of flexibly joining multiple (such as six) peripheral floating modules and a central floating module together. The central floating module is surrounded by the peripheral floating modules after the assembly.

The step of flexibly joining optionally comprises plastic welding the multiple (such as six) peripheral floating modules and the central floating module together.

In some implementations, the step of flexibly joining optionally comprises the steps with seven hexagonal floating modules: a step of joining a first peripheral floating module, a second peripheral floating module, a third peripheral module, a fourth peripheral module, a fifth peripheral floating module and a sixth peripheral floating module to a central floating module from a first direction, a second direction, a third direction, a fourth direction, a fifth direction and a sixth direction, respectively; and a step of joining the first peripheral floating module, the second peripheral floating module, the third peripheral module, the fourth peripheral module, the fifth peripheral floating module and the sixth peripheral floating module in sequence.

The step of flexibly joining optionally comprises a step of joining a first peripheral floating module, a second peripheral floating module, a third peripheral module, a fourth peripheral module, a fifth peripheral floating module and a sixth peripheral floating module in sequence which leave a cavity in a central region; a step of placing a central floating module inside the central region; and a step of joining the first peripheral floating module, the second peripheral floating module, the third peripheral module, the fourth peripheral module, the fifth peripheral floating module and the sixth peripheral floating module to the central floating module from a first direction, a second direction, a third direction, a fourth direction, a fifth direction and a sixth direction, respectively.

The step of flexibly joining optionally comprises a step of flexibly bonding a plurality of damping matts to two side tubes of two adjacent or neighbouring floating modules (such as two adjacent or neighbouring floating modules), respectively. In some implementations, clamping mechanisms and securements are preinstalled on the both sides of each floating module to aid quick marine installation and connection process between the floating modules at sea without use of divers or complex tooling.

The method of assembling optionally further comprises a step of installing at least one bumper or spacer at the damping matt.

The method of assembling optionally further comprises a step of coupling a central sinker to the central floating module for fixing as well as stabilizing the floating platform as a whole.

Alternatively, the method of assembling optionally further comprises a step of coupling a peripheral sinker to the peripheral floating modules also for fixing as well as stabilizing the floating platform as a whole.

The method of assembling optionally further comprises a step of installing an electrical energy storage to the central floating module.

The method of assembling optionally further comprises a step of installing a canopy at the floating platform either at the central floating module or the peripheral floating module. The canopy can protect the facilities (such as the solar panels) from undesirable marine conditions (such as raining, snowing, winds as well as bird soiling).

As a sixth aspect, the application discloses a method of making an offshore system for harvesting renewable energy (particularly green energy) in a large water body. The method of making comprises a step of flexibly joining a plurality of the floating platforms as described in the second aspect.

The method of making optionally further comprises a step of mounting a plurality of solar panels onto the floating platforms for harvesting solar energy into electrical energy.

The method of making optionally further comprises a step of mounting a plurality of wind turbines onto the floating platforms for harvesting wind energy into electrical energy.

The method of making optionally further comprises a step of mounting a plurality of wave energy converters (WECs) onto the floating platforms for harvesting wave power into electrical energy.

The method of making optionally further comprises a step of mounting a plurality of hydrokinetic turbines onto the floating platforms for harvesting tidal power into electrical energy.

The method of making optionally further comprises a step of installing a combiner box onto the offshore system for combing the electrical energy.

The method of making optionally further comprises a step of installing a central inverter onto the offshore system for changing direct current (DC) to alternating current (AC).

The method of making optionally further comprises a step of installing a transformer onto the offshore system for transmitting alternative current for interconnecting with a power grid.

The method of making optionally further comprises a step of constructing a dock for loading and unloading a ship, The method of making optionally further comprises a step of maintaining the offshore system in a clean condition.

The accompanying figures (Figs.) illustrate embodiments and serve to explain principles of the disclosed embodiments. It is to be understood, however, that these figures are presented for purposes of illustration only, and not for defining limits of relevant applications.

Figure 1:
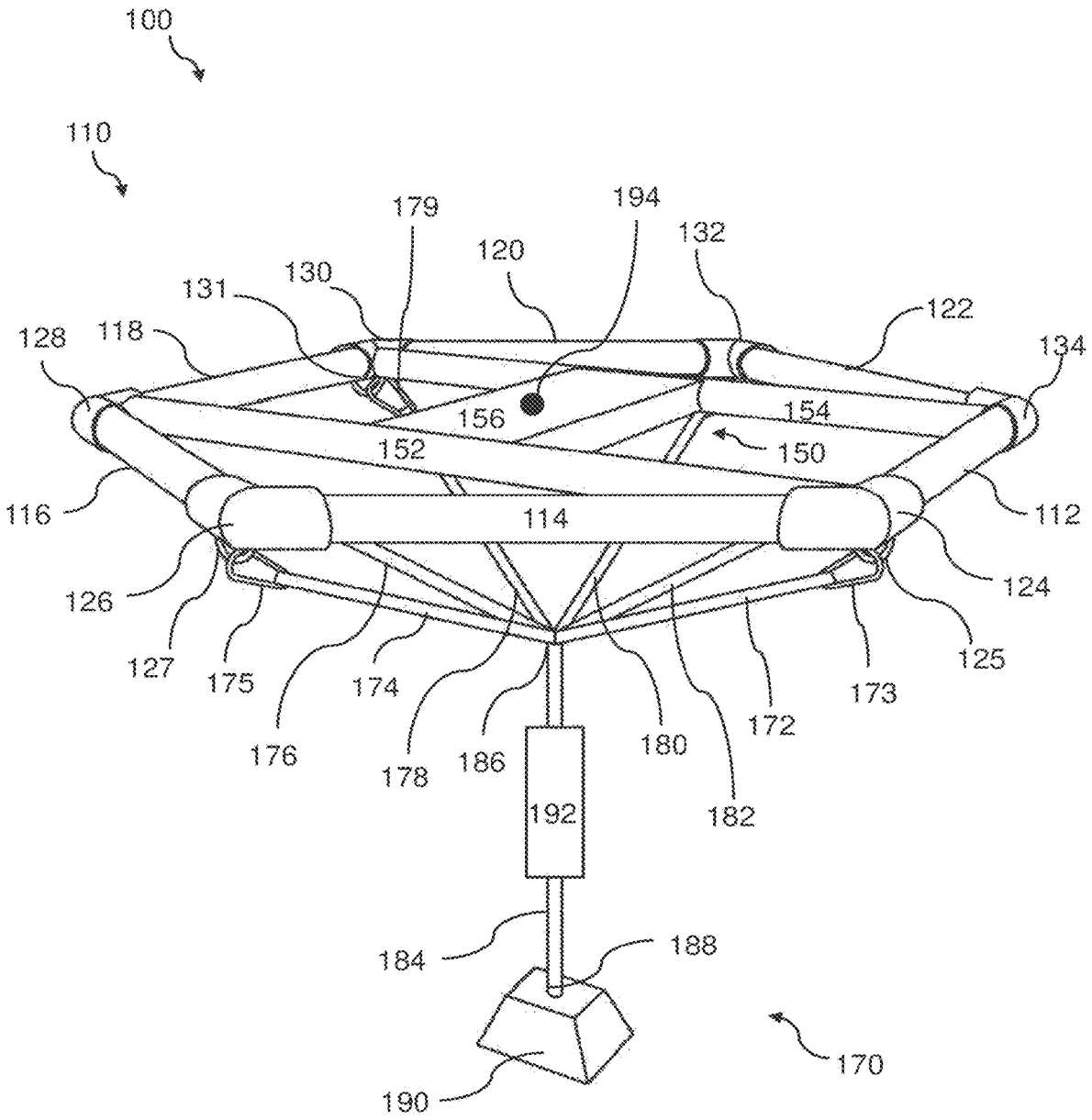
FIG. 1 illustrates a perspective view of a hexagonal floating module having a mooring mechanism in accordance to an embodiment.

FIG. 1 illustrates a perspective view of a hexagonal floating module 100 in accordance to an embodiment. The hexagonal floating module 100 has an external frame 110 constructed by combining a first side tube 112, a second side tube 114, a third side tube 116, a fourth side tube 118, a fifth side tube 120 and a sixth side tube 122 in sequence for defining a hexagonal boundary for the hexagonal floating module 100. The first side tube 112 and the second tube 114 are combined by a first elbow 124; the second side tube 114 and the third side tube 116 are combined by a second elbow 126; and similarly, a third elbow 128, a fourth elbow 130, a fifth elbow 132 and a sixth elbow 134 are used for combining the other side tubes 116-122 respectively for making the external frame 110 into a unitary structure. The side tubes 112-122 preferably have a same structure with a same length L, and the elbows 124, 126, 128, 130, 132, 134 also have a same structure; and thus the external frame 110 has a symmetrical configuration to an imaginary central point 194.

The hexagonal floating module 100 has an internal frame 150 coupled to the external frame 110. The internal frame 150 has a first bar 152 coupled to the first elbow 124 and the third elbow 128; and a second bar 154 coupled to the fourth elbow 130 and the sixth elbow 134. Therefore, the first bar 152 and the second bar 154 are parallel to each other. It is understood that the first bar 152 and the second bar 154 may have other configurations for forming the internal frame 150. The internal frame 150 also has a panel 156 coupled to the first bar 152 and the second bar 154. The panel 156 may have various shapes for matching one or more facilities mounted thereon, such as a rectangular shown herein for solar panels.

The hexagonal floating module 100 has a mooring mechanism 170 for fixing the floating module 100 in position at the sea or ocean. The mooring mechanism 170 has a first branch string 172, a second branch string 174, a third branch string 176, a fourth branch string 178, a fifth branch string 180 and a sixth branch string 182 coupled to the elbows 124-134, respectively. The coupling can be conducted by any known technologies, such as tying, welding, adhering as well as fastening. For example, the external frame 110 has a first hook 125, a second hook 127, a third hook 129, a fourth hook 131, a fifth hook 133 and a sixth hook 135 at the elbows 124-134, respectively. The branch strings 172, 174, 176, 178, 180, 182 are coupled to the hooks 125, 127, 129, 131, 133, 135 via a first catch 173, a second catch 175, a third catch 177, a fourth catch 179, a fifth catch 181 and a sixth catch 183, respectively. It is also understood that the hooks 125, 127, 129, 131, 133, 135 may be at other locations of the side tubes 112-122, such as middle points of the side tubes 112-122 respectively. The branch strings 172, 174, 176, 178, 180, 182 are also coupled to a first end 186 of a trunk string 184 opposed to the external frame 110; and a sinker 190 is coupled to a second end 188 of the trunk string 184. The sinker 190 applies a pulling force to the hexagonal floating module 100 by its gravity; and the pulling force is transmitted via the trunk string 184, then via the branch strings 172, 174, 176, 178, 180, 182 and finally to the elbows 124, 126, 128, 130, 132, 134. Therefore, the puling force is distributed evenly across the external frame 110 for making the floating module 100 more stabilized and balanced. In addition, a shock absorber 192 is coupled to the trunk string 184 for converting kinetic energy brought by external shocks into another form of energy (such as thermal energy or heat) which is dissipated from the floating module 100 without causing any influence or damage.

Figure 2:
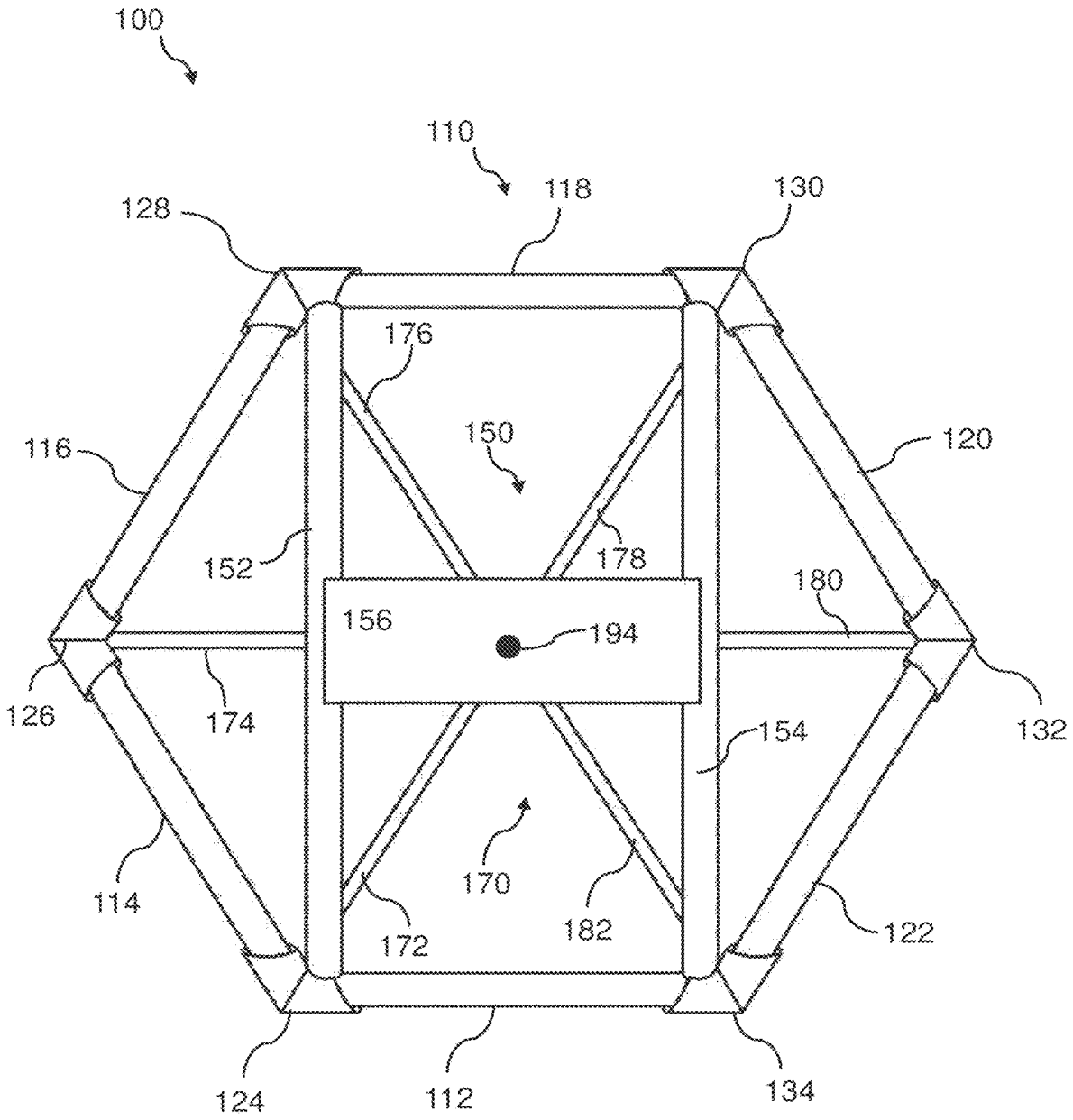
FIG. 2 illustrates a top planar view of the hexagonal floating module in FIG. 1.

FIG. 2 illustrates a top planar view of the hexagonal floating module 100 in FIG. 1. It is clearly seen that all the external frame 110, the internal frame 150 and the mooring mechanism 170 have symmetrical configuration to the imaginary central point 194. In particular, the branch strings 172, 174, 176, 178, 180, 182 are symmetrically distributed to the imaginary central point 194, and the truck string 184 and the sinker 190 are suspended directly under the imaginary central point 194. Therefore, the hexagonal floating module 100 has a symmetrical configuration to the imaginary central point 194 as a whole. If the facility for harvesting renewable energy is mounted symmetrically to the imaginary central point 194, a load of the facility is also distributed symmetrically to the hexagonal floating module 100 for further stabilizing and balancing the entire structure.

Figure 3:
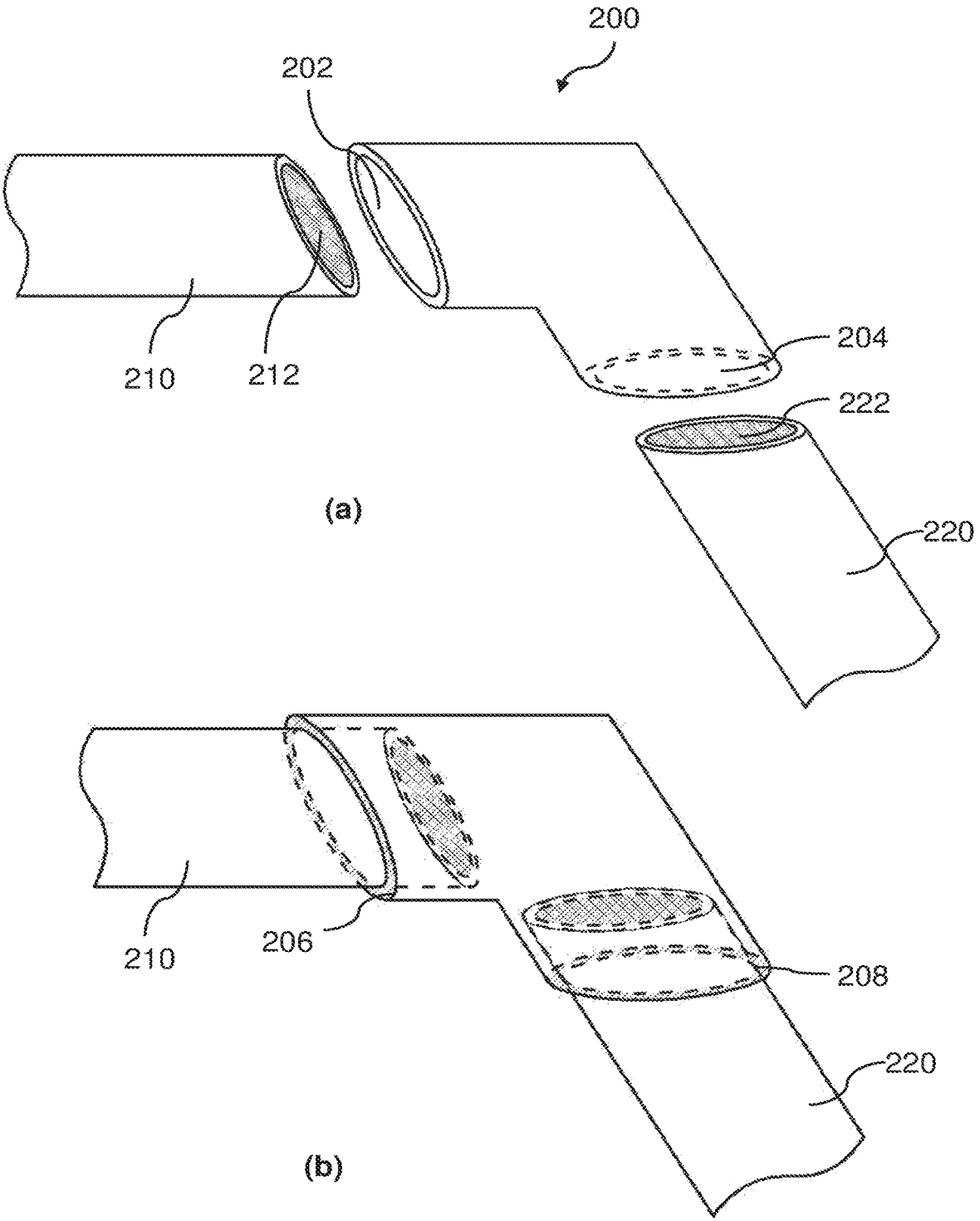
FIG. 3 illustrates an enlarged view of an unsealed elbow for connecting two sealed side tubes: (a) before assembly; and (b) after assembly in accordance to an embodiment.

FIG. 3 illustrates an enlarged view of an unsealed elbow 200 for connecting two sealed side tubes (i.e. a first sealed side tube 210 and a second sealed side tube 220). FIG. 3(*a*) shows the unsealed elbow 200 and the sealed side tubes 210, 220 before assembly. The first sealed side tube 210 and the second sealed side tubes 220 have a first closed end 212 and a second closed end 222 respectively, both of which are hermetically sealed to prevent sea water from entering into the sealed side tubes 210, 220, respectively. Similarly, opposed ends of the sealed side tubes 210, 220 are also hermetically closed (not shown in FIG. 3(*a*)). Therefore, the sealed side tubes 210, 220 are individually water-proof to sea water unless they are failed by being broken or damaged. The closed ends 212, 222 of the sealed side tubes 210, 220 may be conducted via any known technologies, such as plugging, welding and adhering. FIG. 3(*b*) shows the unsealed elbow 200 and the sealed side tubes 210, 220 after assembly. The unsealed elbow 200 has a first opening 202 and a second opening 204 with inner diameters that are slightly larger than outer diameters of the sealed side tubes 210, 220, respectively. Therefore, the first sealed side tube 210 and the second sealed side tube 220 can be hermitically assembled with the unsealed elbow 200 by tightly inserting the first closed end 212 and the second closed end 222 into the first opening 202 and the second opening 204, respectively (as shown in dotted lines). In addition, a first sealant 206 and a second sealant 208 are applied to the first opening 202 and the second opening 204 to further prevent the sea water from entering into the unsealed elbow 200. The sealants 206, 208 may be applied using any known technologies, such as welding and adhering according to specific materials of the unsealed elbow 200. If all the side tubes 112-122 of the hexagonal floating module 100 in FIG. 1 and FIG. 2 have a same structure as the sealed side tubes 210, 220 and assembled with the unsealed elbows 124, 126, 128, 130, 132, 134, respectively, the hexagonal floating module 100 would not sink if one of the side tubes 112-122 is failed, since all the side tubes 112-122 are individually and hermetically sealed by themselves.

Figure 4:
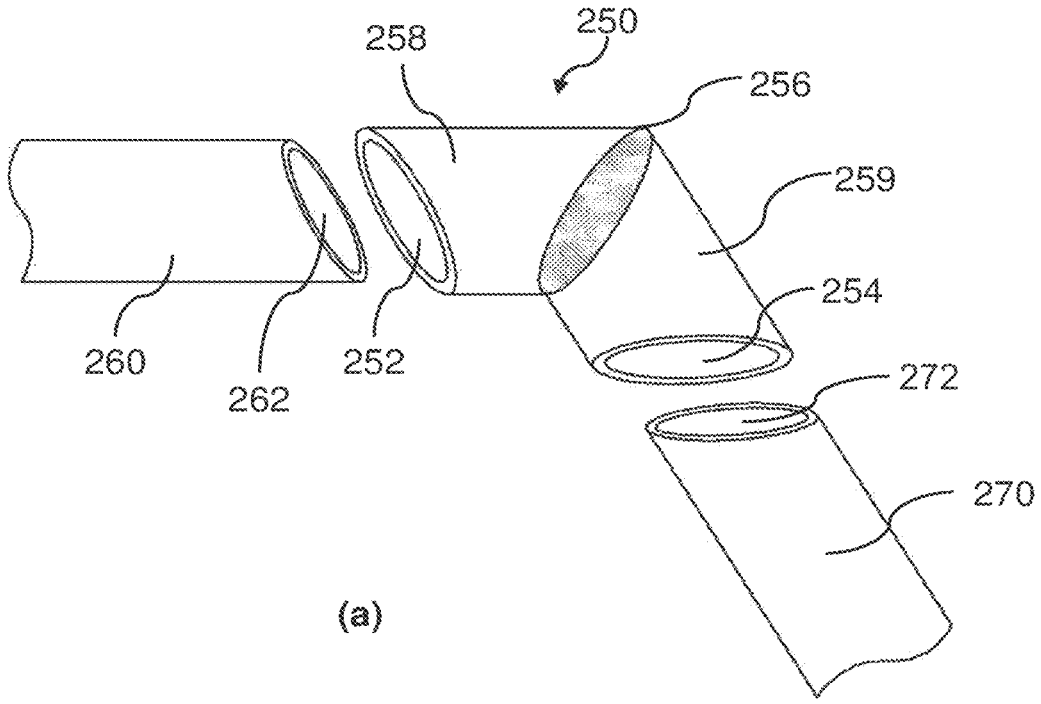
FIG. 4 illustrates an enlarged view of a sealed elbow for connecting two unsealed side tubes: (a) before assembly; and (b) after assembly in accordance to an embodiment.
Figure 4:
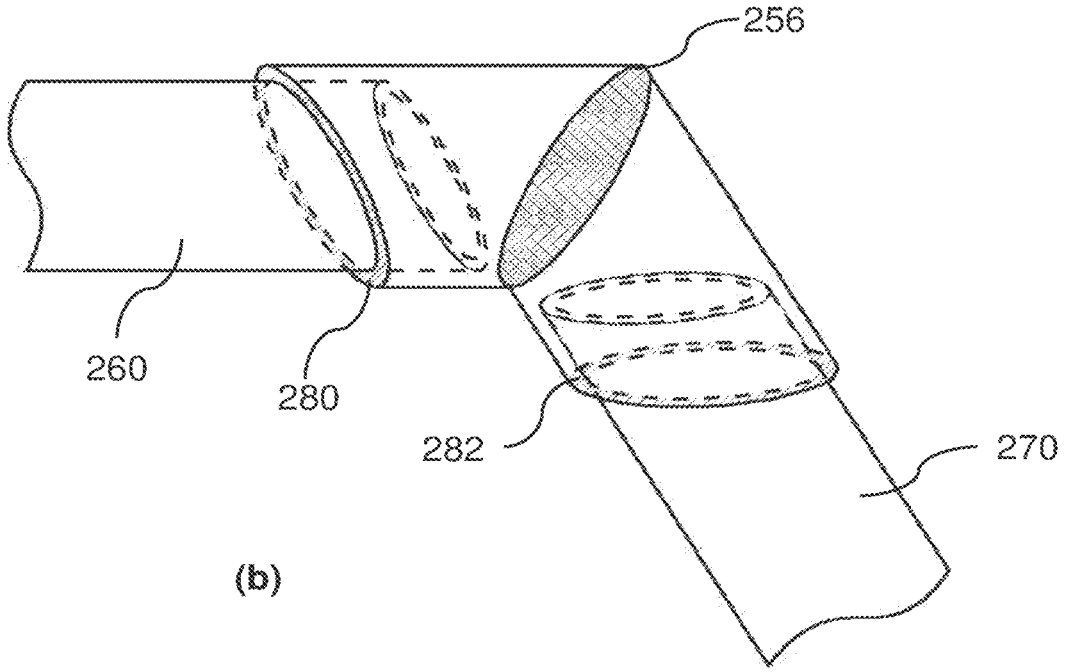

FIG. 4 illustrates an enlarged view of a sealed elbow 250 for connecting two unsealed side tubes (i.e. a first unsealed side tube 260 and a second unsealed side tube 270). FIG. 4(*a*) shows the sealed elbow 250 and the unsealed side tubes 260, 270 before assembly. Similar to the unsealed elbow 200, the sealed elbow 250 has a first opening 252 and a second opening 254, but the sealed elbow 250 is sealed internally, preferably at its angled portion 256. Therefore, the sealed elbow 250 is separated into a first portion 258 and a second portion 259 by the angled portion; and sea water cannot flow between the first portion 258 and the second portion 259. In contrast to the sealed side tubes 210, 220, the first unsealed side tube 260 and the second unsealed side tube 270 have a first open end 262 and a second open end 272, respectively. FIG. 4(*b*) shows the sealed elbow 250 and the unsealed side tubes 260, 270 after assembly. The sealed elbow 250 has inner diameters that are slightly larger than outer diameters of the unsealed side tubes 260, 270, respectively. Therefore, the first unsealed side tube 260 and the second unsealed side tube 270 can be hermitically assembled with the sealed elbow 250 by tightly inserting the first open end 262 and the second open end 272 into the first opening 252 and the second opening 264, respectively (as shown in dotted lines). In particular, sea water still cannot flow between the first unsealed side tube 260 and the second unsealed side tube 270 due to the sealed elbow 250. In addition, a first sealant 280 and a second sealant 282 are applied to the first opening 252 and the second opening 254 to further prevent the sea water from entering into the unsealed elbow 200. The sealants 280, 282 may be applied using any known technologies, such as welding and adhering according to specific materials of the sealed elbow 250. As a result, the first opening 252 and the second open end 262 are hermetically accommodated inside the first portion 258 and the second portion 259 respectively and separated by the angled portion 256. If all the side tubes 112-122 of the hexagonal floating module 100 in FIG. 1 and FIG. 2 have a same structure as the unsealed side tubes 260, 270 and assembled with the sealed elbows 124, 126, 128, 130, 132, 134, respectively, the hexagonal floating module 100 would not sink if one of the side tubes 112-122 is failed, since all the side tubes 112-122 are hermetically sealed by the sealed elbows 124, 126, 128, 130, 132, 134. It is also possible to assemble the sealed side tubes 210, 220 with the sealed elbow 250 for providing additional protection from the sea water.

Figure 5:
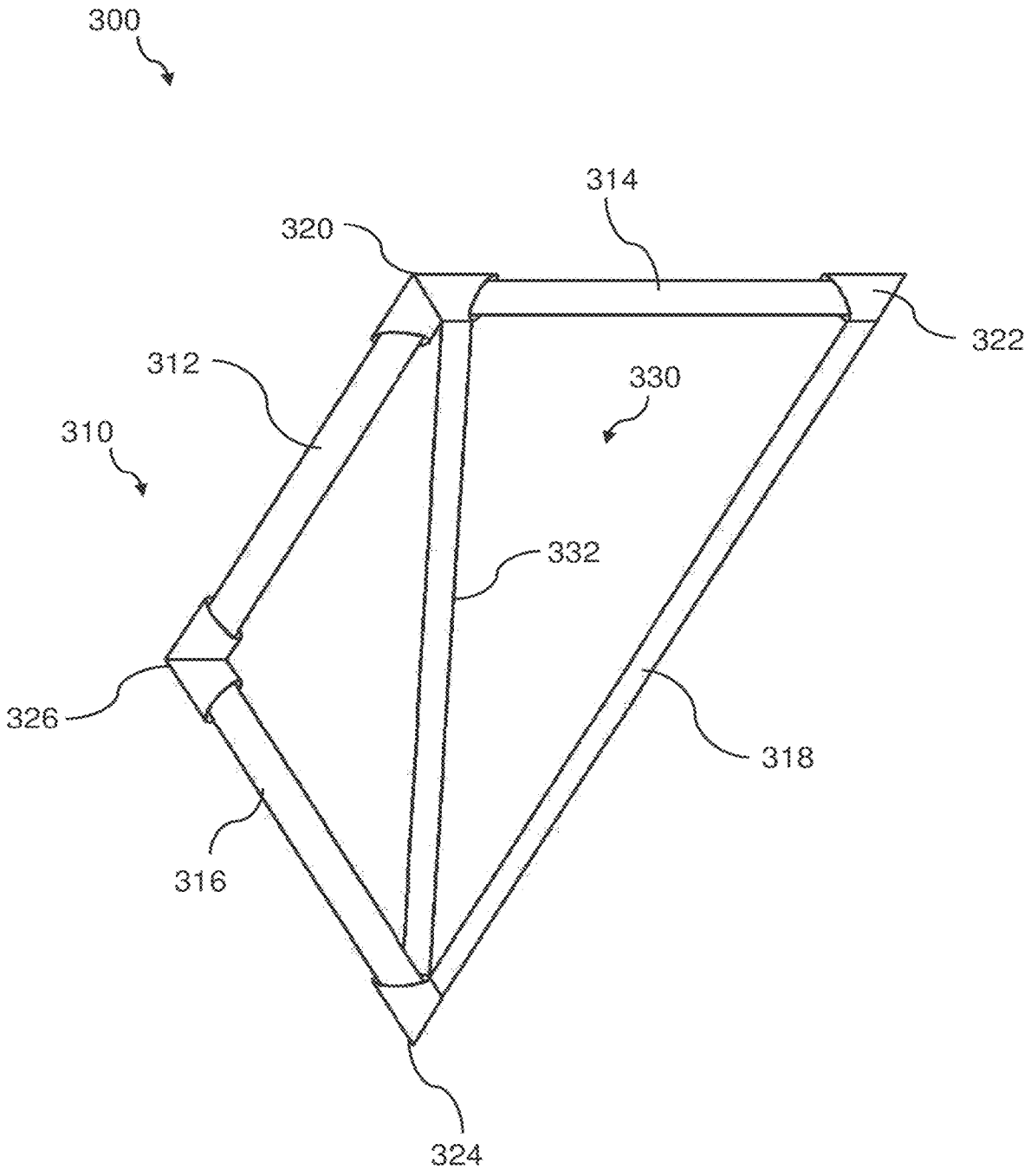
FIG. 5 illustrates a top planar view of a trapezoid floating module in accordance to an embodiment.

FIG. 5 illustrates a top planar view of a trapezoid floating module 300 in accordance to an embodiment. The trapezoid floating module 300 has an externa frame 310 having three short side tubes 312-316 (i.e. a first short side tube 312, a second short side tube 314 and a third 316) with a same length of L, and a long side tube 318 with a length of 2L coupled together. In particular, the first short tube 312 is parallel to the long side tube 318. The first short side tube 312, the second short side tube 314, the long side tube 318 and the fourth short side tube 316 are coupled in sequence by a first elbow 320, a second elbow 322, a third elbow 324 and a fourth elbow 326, respectively. The trapezoid floating module 300 also has an internal frame 330 with a bar 332 coupled to the first elbow 320 and the third elbow 324.

Figure 6A:
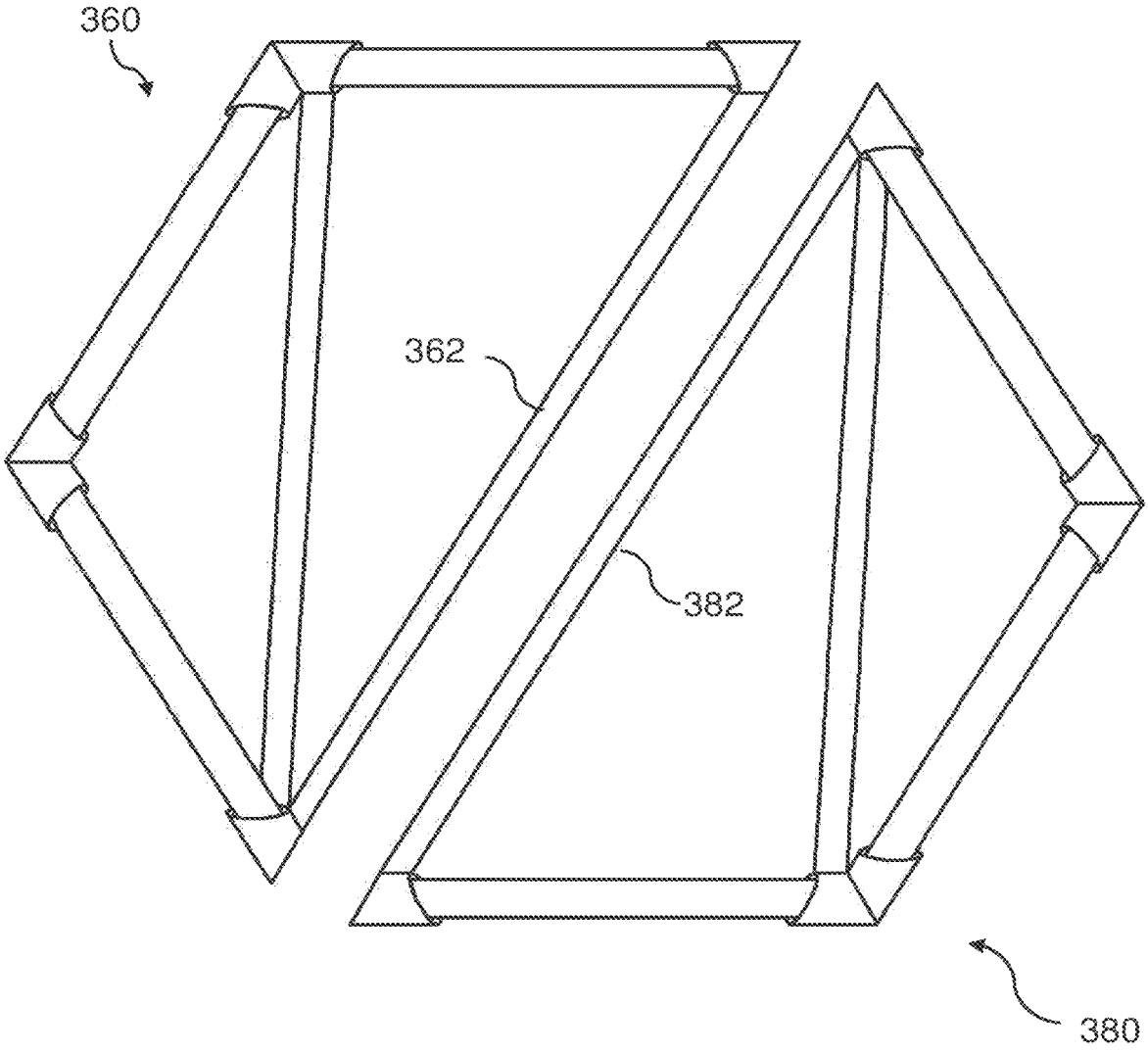
FIG. 6 illustrates a top planar view of another hexagonal floating module assembled by two trapezoid floating modules in FIG. 5 in accordance to an embodiment.
Figure 6B:
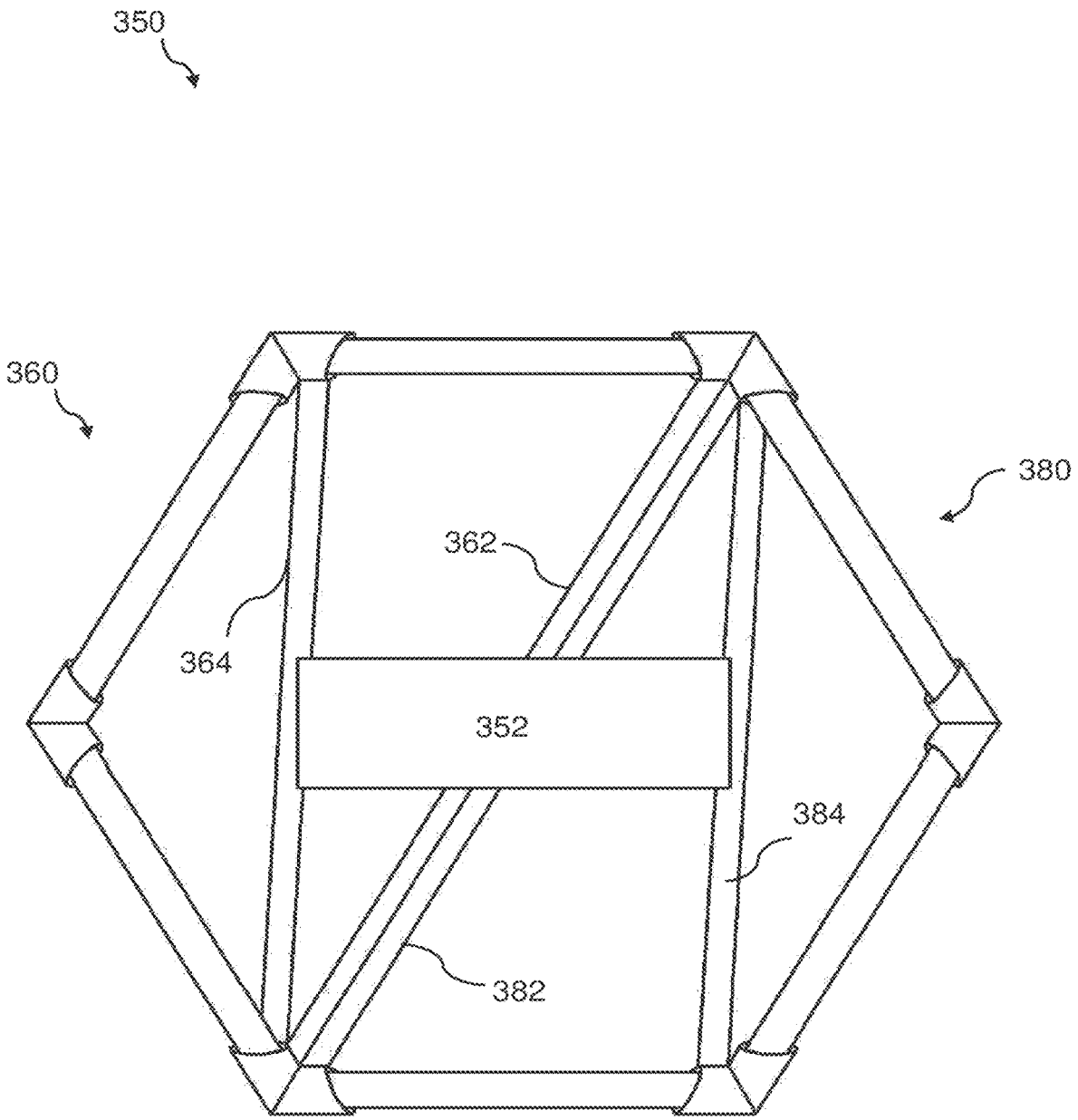

FIG. 6 illustrates a top planar view of another hexagonal floating module 350 assembled by two trapezoid floating modules (i.e. a first trapezoid floating module 360 and a second trapezoid floating module 380) in FIG. 5 in accordance to an embodiment. As shown in FIG. 6(*a*), before assembly, the two trapezoid floating modules 360, 380 are configured with a first long side tube 362 of the first trapezoid floating module 360 and a second long side tube 382 of the second trapezoid floating module 380 facing to each other. As a result, a first bar 364 of the first trapezoid floating module 360 is parallel to a second bar 384 of the second trapezoid floating module 380. As shown in FIG. 6(*b*), the two long side tubes 362, 382 are combined during assembly using any known technologies, such as welding and adhering. Finally, a panel 352 is coupled to the first bar 364 and the second bar 384. As a result, the hexagonal floating modules 100, 350 has a similar structure, except that the hexagonal floating module 350 has the long side tubes 362, 382; and thus the hexagonal floating module 350 has a stronger structural strength.

Figure 7:
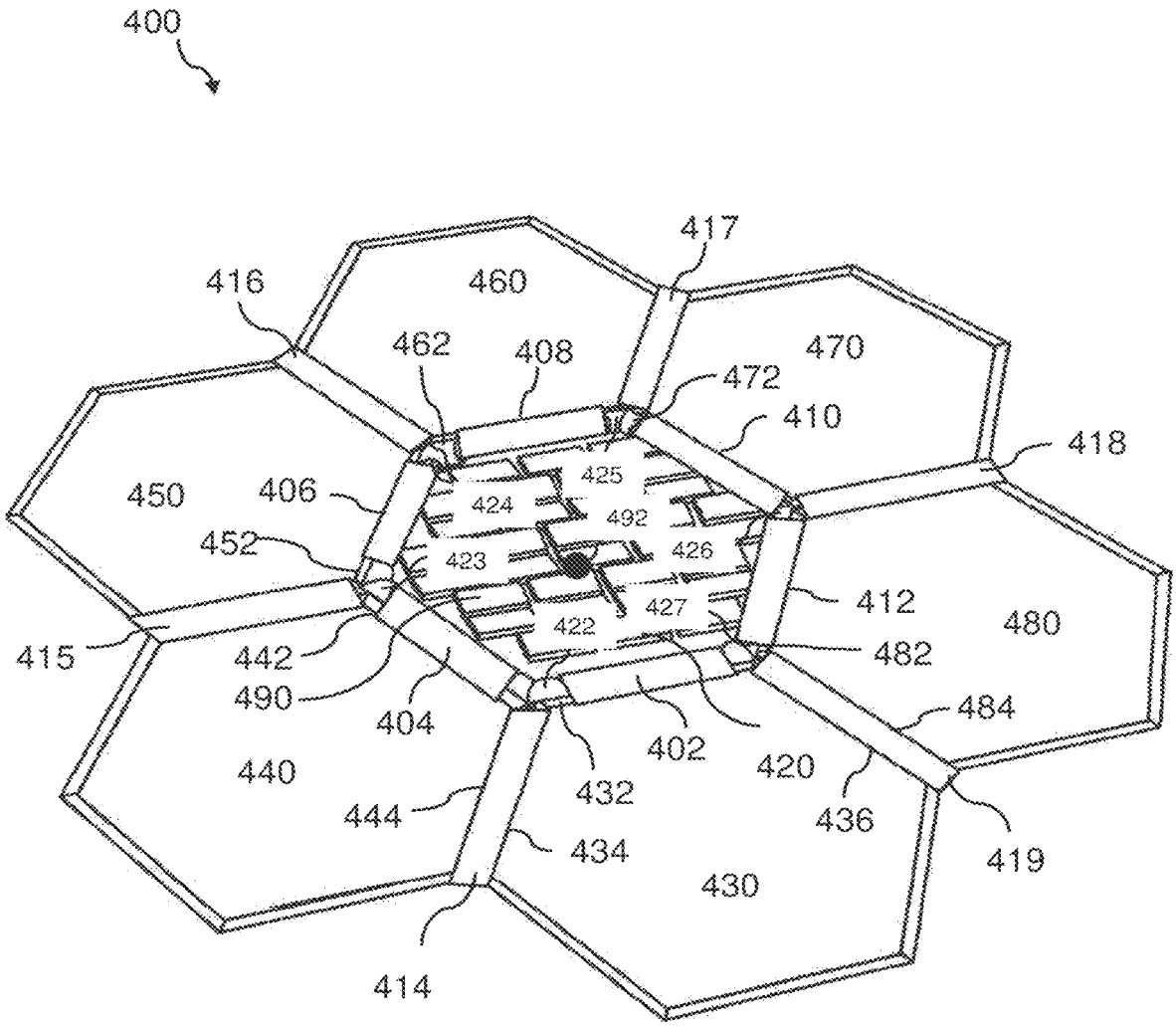
FIG. 7 illustrates a top view of a floating platform assembled by seven hexagonal floating modules in FIG. 1 or FIG. 6 in accordance to an embodiment.

FIG. 7 illustrates a top view of a floating platform 400 assembled by seven hexagonal floating modules in FIG. 1 or FIG. 6 in accordance to an embodiment. The floating platform 400 has a hexagonal floating module 420 at a central position (called central floating module 420); and six hexagonal floating modules 430-480 (i.e. a first peripheral floating module 430, a second peripheral floating module 440, a third peripheral floating module 450, a fourth peripheral floating module 460, a fifth peripheral floating module 470 and a sixth peripheral floating module 480) at peripheries (called peripheral floating modules 430-480) surrounding the central floating module 420. A first fastener 402 is used to combine a first central tube 422 and a first inner side tube 432 to assemble the central floating module 420 and the first peripheral floating module 430. Similarly, other fasteners 404-412 (i.e. a second fastener 404, a third fastener 406, a fourth fastener 408, a fifth fastener 410, a sixth fastener 412) are used to combine the other peripheral floating modules 440, 450, 460, 470, 480 to the central floating module 420 via a second central tube 423 and a second inner side tube 442, third central tube 424 and a third inner side tube 452, a fourth central tube 425 and a fourth inner side tube 462, a fifth central tube 426 and a fifth inner side tube 472, and a sixth central tube 427 and a sixth inner side tube 482 of the central floating module 420, respectively. Similarly, every two of the adjacent or neighboring peripheral floating modules 430-480 are also combined via fasteners 414-419 (i.e. a seventh fastener 414, an eighth fastener 415, a ninth fastener 416, a tenth fastener 417, an eleventh fastener 418 and a twelfth fastener 419). For example, a first left side tube 434 and a first right side tube 436 of the first peripheral floating module 430 are combined respectively with a second right side tube 444 of the second peripheral floating module 440 via the seventh fastener 414 and a sixth left side tube 484 of the sixth peripheral floating module 480, respectively. Therefore, the floating platform 400 has a symmetrical configuration to the central floating module 420, more particularly to an imaginary central point 492 of the central floating module 420.

As shown in FIG. 7, solar panels 490 are mounted on the central floating module 420 for harvesting solar energy at the sea. It is understood that more solar panels 490 may also be mounted on the peripheral floating modules 430-480 for partially or fully covering the floating platform 400.

Figure 8:
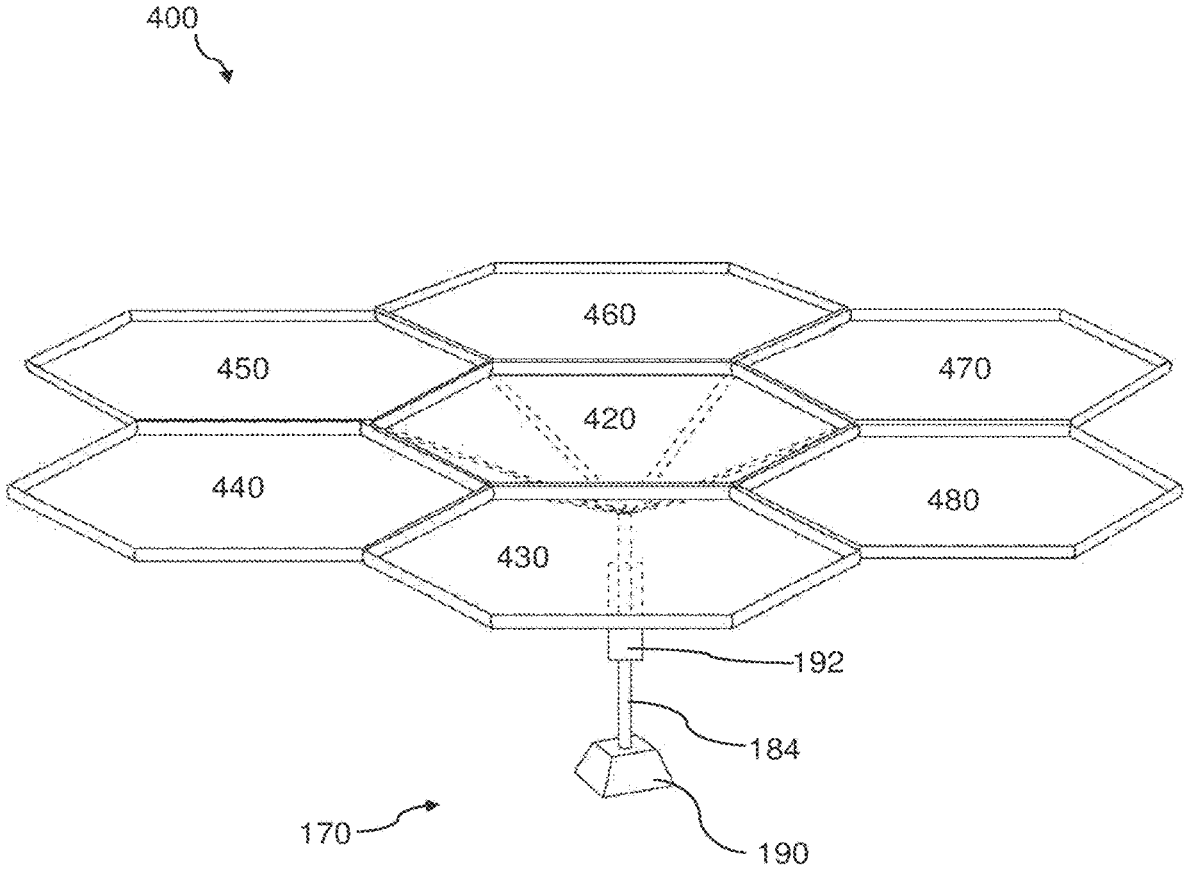
FIG. 8 illustrates a perspective view of the floating platform in FIG. 7 with the mooring mechanism in FIG. 1 according to an embodiment.

FIG. 8 illustrates a perspective view of the floating platform 400 in FIG. 7 with the mooring mechanism 170 in FIG. 1 according to an embodiment. The mooring mechanism 170 is coupled to the central floating module 420 in a symmetrical manner to the imaginary central point 492 and thus the pulling force from the mooring mechanism 170 is evenly distributed across the floating platform 400.

Figure 9:
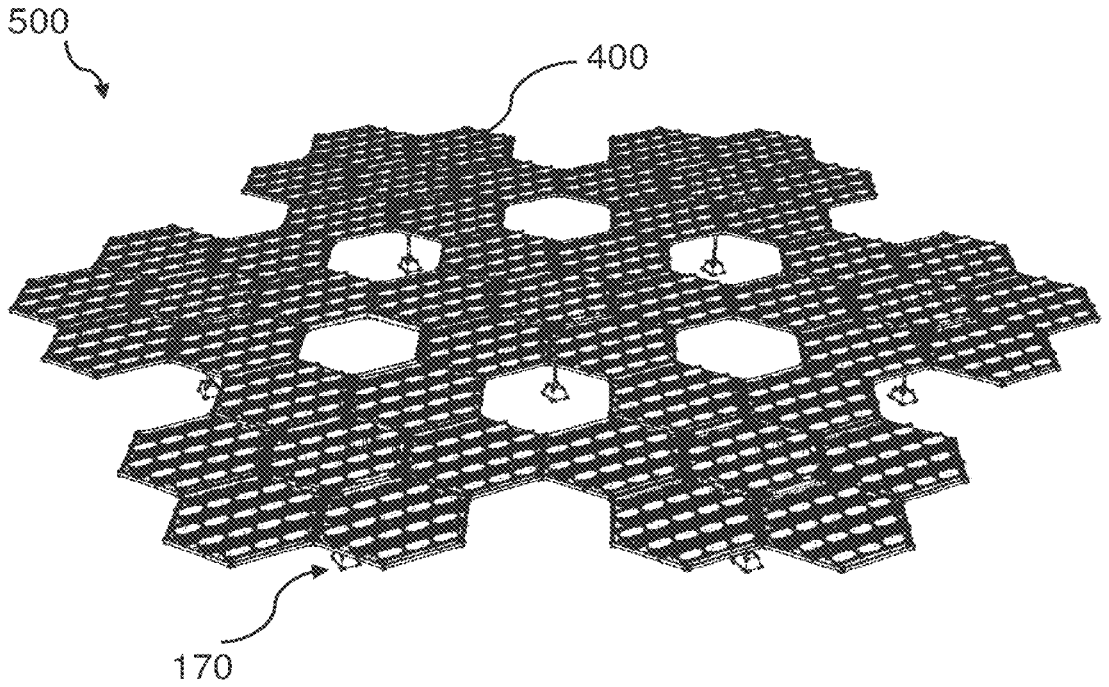
FIG. 9 illustrates (a) a top perspective view and (b) a side perspective of an offshore system assembled by the floating platform in FIG. 8 in accordance to an embodiment.
Figure 9:
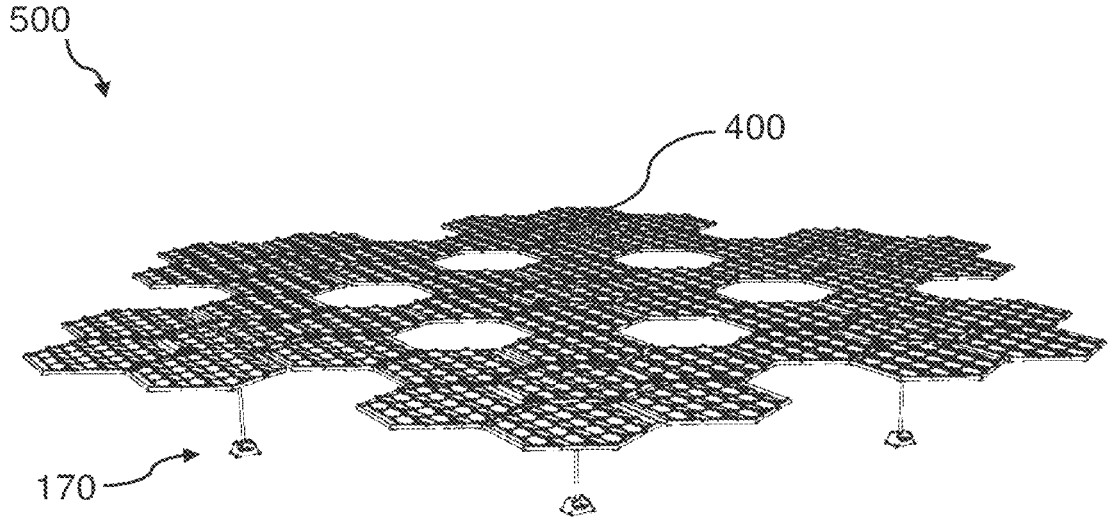

FIG. 9 illustrates (a) a top perspective view and (b) a side perspective of an offshore system 500 assembled by the floating platforms 400 in FIG. 8 in accordance to an embodiment. Various facilities for harvesting renewable energies, particularly green energies are mounted onto the offshore system 500, such as solar panels 510 for harvesting solar energy and wind turbines 520 for harvesting wind energy. In particular, the wind turbines 520 has very tall profiles which would substantially not block the sun to the solar panels 510 mounted below and around the wind turbines 520. For each floating platform 400, it is preferable that the wind turbines 520 are mounted on the central floating module 420 while the solar panels 510 are mounted on the peripheral floating modules 430-480. This design has an advantage of distrusting loads of the solar panels 510 and the wind turbines 520 evenly across the offshore system 500, which makes the offshore system 500 more stabilized at the sea.

Figure 10:
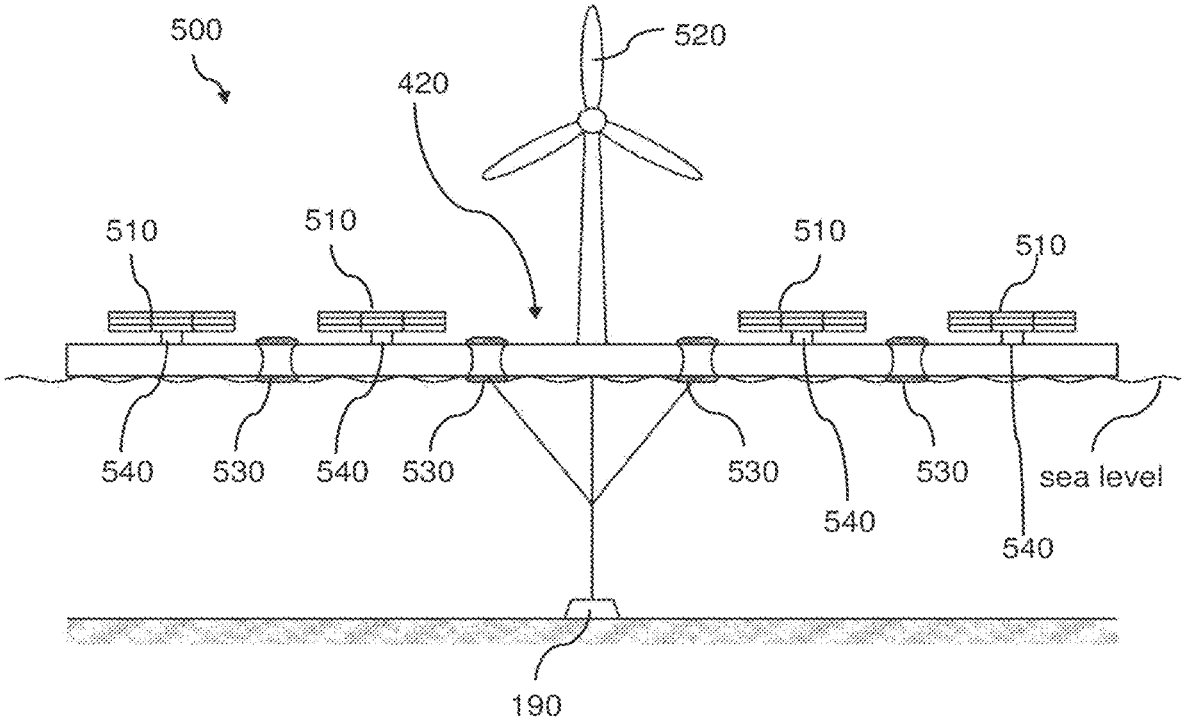
FIG. 10 illustrates a side view of the offshore system in FIG. 9.

FIG. 10 illustrates a side view of the offshore system 500 in FIG. 9. Damping matts 530 are used for flexibly binding or interlocking two neighboring floating platforms 400. The damping matts 530 would protect the floating platforms 400 by absorbing external shocking or vibrational energy of the sea water. Meanwhile, the damping matts also server as service walkways for human staffs or machines to move on the offshore system 500. Gaps 532 exist between two neighboring damping matts 530 but are less than 30 centimeters (cm) for providing a continuous walkway for the human staff. Each damping matt 530 has a length enough for substantially covers the side tube of the floating platforms 400 entirely such that the human staff or machines can get access to every location around the offshore system 500. In addition, tracking devices 540 are mounted beneath the solar panels 510 for adjusting the solar panels 510 always towards the sun for harvesting the solar energy more efficiently.

Figure 11:
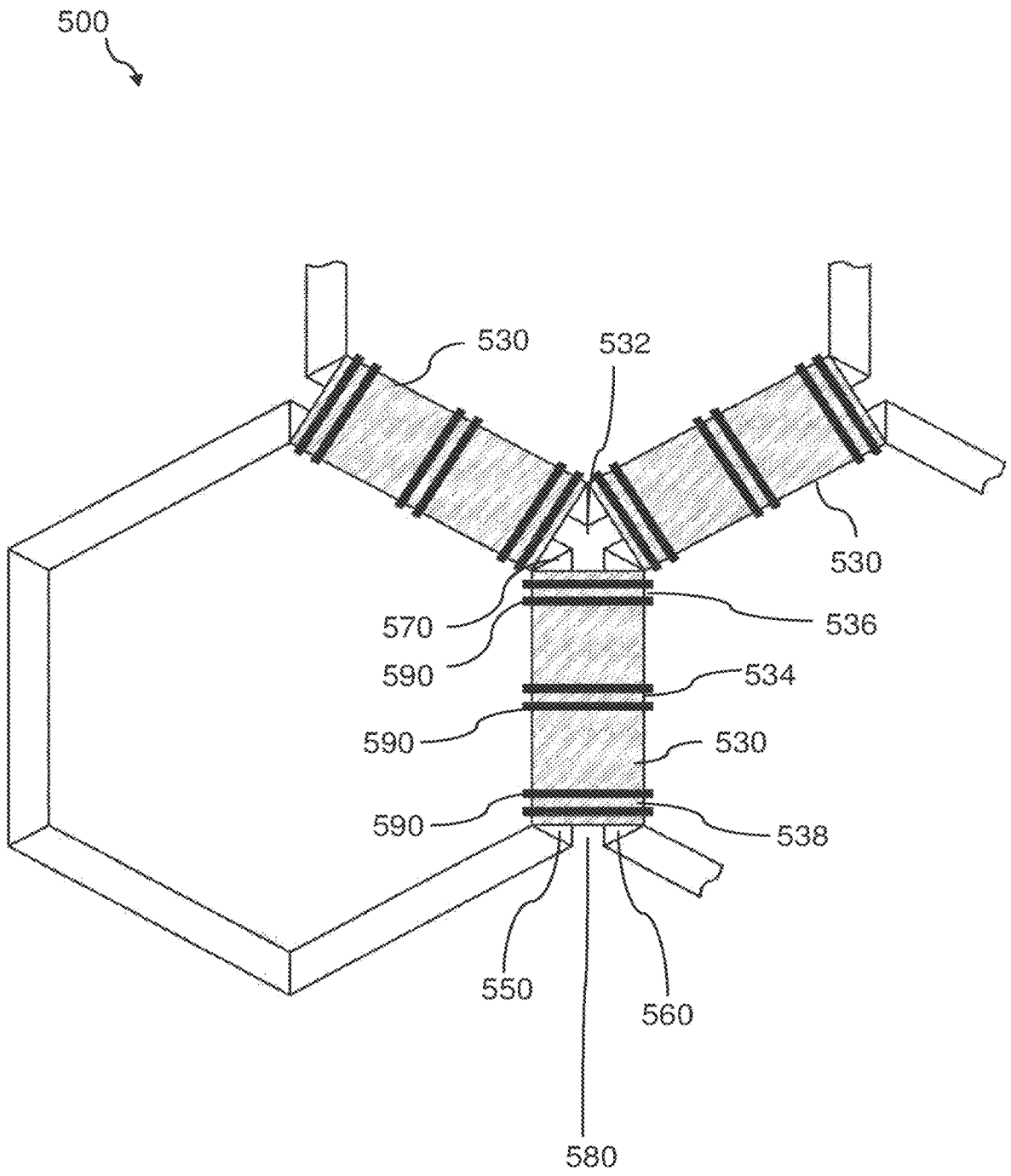
FIG. 11 illustrates an enlarged top planar view of damping matts interlocking two side tubes in accordance to an embodiment.

FIG. 11 illustrates an enlarged top planar view of damping matts 530 interlocking two side tubes 550, 560 (i.e. a first side tube 550 and a second side tube 560) in accordance to an embodiment. The damping matt 530 extends along the side tubes 550, 560 between two elbows 570, 580 (i.e. a first elbow 570 and a second elbow 580); and all the damping matts 530 thus extend across the entire offshore system 500. In addition, fastening bonds 590 are applied on the damping matt 530 for securing the damping matt 530 in place and preventing the damping matt 530 from sliding away from its original position. In FIG. 11, three fastening bonds 590 are applied to a middle portion 534 and two ends 536, 538 (i.e. a first end 536 and a second end 538) of the damping matt 530, respectively. It is understood that the layout of the three fastening bonds 590 as shown in FIG. 11 is exemplary only; and other layouts of applying the fastening bonds 590 to the damping matts 530 are also within the inventive concept of the subject application.

Figure 12:
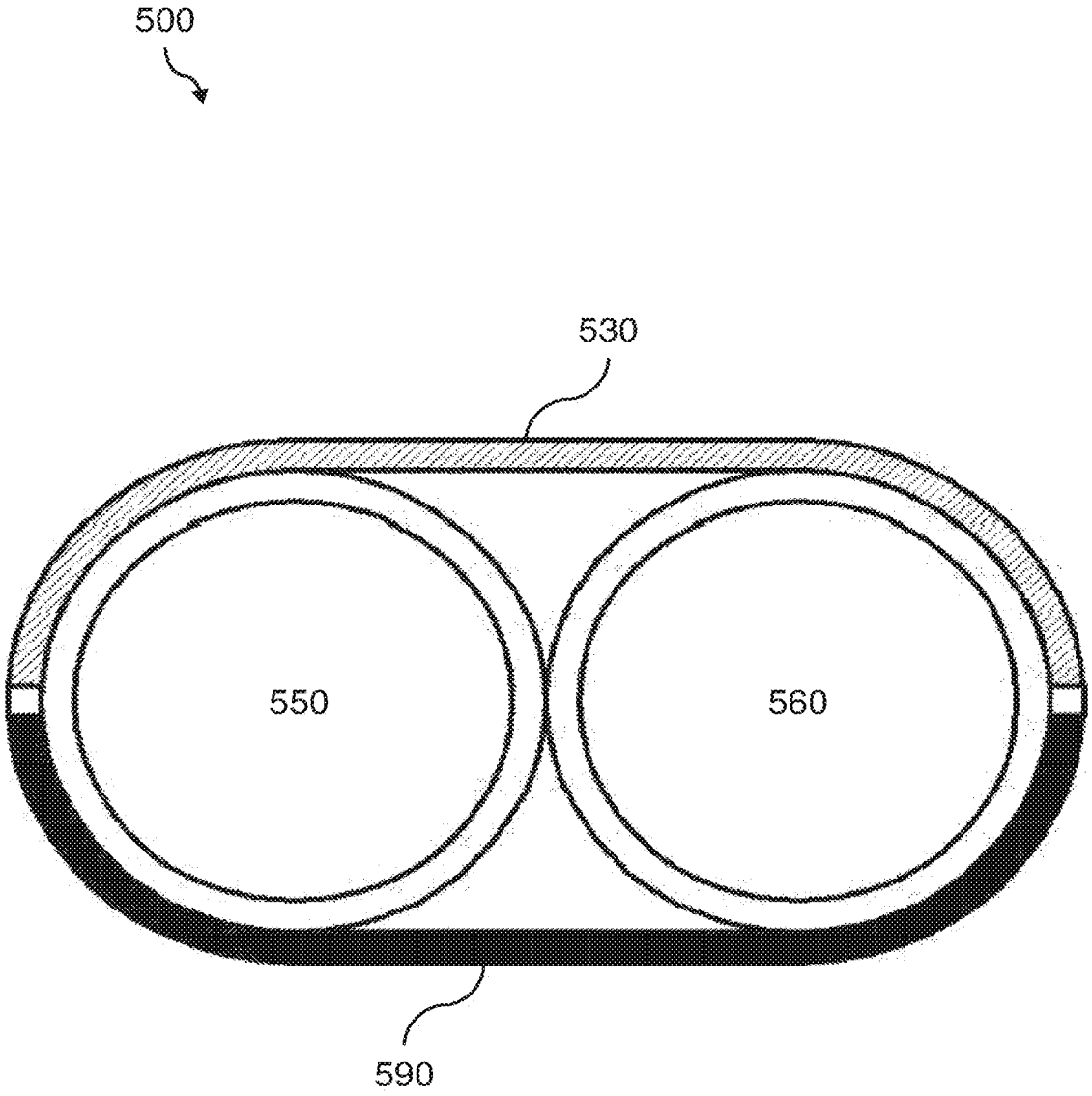
FIG. 12 illustrates a cross-sectional view of the damping matts in FIG. 11.

FIG. 12 illustrates a cross-sectional view of the damping matts 530 in FIG. 11. The damping matt 530 only covers upper portions of the side tubes 550, 560 for saving materials of the damping matt 530. Alternatively, the damping matt 530 may cover the side tubes 550, 560 completely for forming a closed loop if the offshore system 500 would be deployed to specific sea area where strong winds or even storms are frequent to occur. The side tubes 550, 560 have a smooth surface so that they can rotate to each other without much hindrance. Therefore, the offshore system 500 can resist external shocks or storms more effectively by rotating the side tubes 550, 560 to each other. After the external shocks or storms, the side tubes 550, 560 would return to their original positions due to the force of gravity.

In an exemplary embodiment of the subject invention, the side tube is made of High Density Poly Ethylene (HDPE) and has an outside diameter (OD) of 500/315 millimetres (mm) and a length of 12 meters (m). Six side tubes makes up a hexagonal floating module which has a buoyance of 64 kilograms per meter (kg/m) (for the side tubes having OD of 315 mm) or 160 kilograms per meter (kg/m) (for the side tubes having OD of 500 mm). Multiple floating modules then make up the floating platform applicable for both freshwater floating photo-voltage (FPV) and saltwater floating photo-voltage (FPV), which may have a power output/cluster of 100 to 200 kilowatts peak (kWp). Facilities of various solar types could be installed onto the floating platform, including larger foam factor mono type, poly crystalline frameless type or with frame mono & bifacial type. Hybrid energies can be harvested, such as solar energy and wind energy (such as low velocity WTG). In addition, integrated mooring with elastomers for tidal variation is also attached to the floating platform; particularly the integrated mooring has mooring line force distribution to the floating modules on water surface.

Furthermore, frames and brackets made of stainless steel or aluminium are also installed to the floating platform. Other equipments are also installed with the floating platform to make up the floating system, including inverters, combiners and DC/DC converter. In addition, cable management inter-array is implemented by being integrated with walkways of the floating platform; while cable management export is implemented by being integrated and subsea cable hang off.

In the application, unless specified otherwise, the terms "comprising", "comprise", and grammatical variants thereof, intended to represent "open" or "inclusive" language such that they include recited elements but also permit inclusion of additional, non-explicitly recited elements.

As used herein, the term "about", in the context of concentrations of components of the formulations, typically means +/−5% of the stated value, more typically +/−4% of the stated value, more typically +/−3% of the stated value, more typically, +/−2% of the stated value, even more typically +/−1% of the stated value, and even more typically +/−0.5% of the stated value.

Throughout this disclosure, certain embodiments may be disclosed in a range format. The description in range format is merely for convenience and brevity and should not be construed as an inflexible limitation on the scope of the disclosed ranges. Accordingly, the description of a range should be considered to have specifically disclosed all the possible sub-ranges as well as individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

It will be apparent that various other modifications and adaptations of the application will be apparent to the person skilled in the art after reading the foregoing disclosure without departing from the spirit and scope of the application and it is intended that all such modifications and adaptations come within the scope of the appended claims.

REFERENCE NUMERALS

100 hexagonal floating module;
110 external frame;

112 first side tube;
114 second side tube;
116 third side tube;
118 fourth side tube;
120 fifth side tube;
122 sixth side tube;
124 first elbow;
125 first hook;
126 second elbow;
127 second hook;
128 third elbow;
129 third hook (not shown);
130 fourth elbow;
131 fourth hook;
132 fifth elbow;
133 fifth hook (not shown);
134 sixth elbow;
135 sixth hook (not shown);
150 internal frame;
152 first bar;
154 second bar;
156 panel;
170 mooring mechanism;
172 first branch string;
173 first catch;
174 second branch string;
175 second catch;
176 third branch string;
177 third catch (not shown);
178 fourth branch string;
179 fourth catch;
180 fifth branch string;
181 fifth catch (not shown);
182 sixth branch string;
183 sixth catch (not shown);
184 trunk string;
186 first end;
188 second end;
190 sinker;
192 shock absorber;
194 imaginary central point;
200 unsealed elbow;
202 first opening;
204 second opening;
206 first sealant;
208 second sealant;
210 first sealed side tube;
212 first closed end;
220 second sealed side tube;
222 second closed end;
250 sealed elbow;
252 first opening;
254 second opening;
256 angled portion;
258 first portion;
259 second portion;
260 first unsealed side tube;
262 first open end;
270 second unsealed side tube;
272 second open end (not shown);
280 first sealant;
282 second sealant;
300 trapezoid floating module;
310 external frame;
312 first short side tube;
314 second short side tube;
316 third short side tube;
318 long tube;
320 first elbow;
322 second elbow;
324 third elbow;
326 fourth elbow;
330 internal frame;
332 bar;
350 hexagonal floating module;
352 panel;
360 first trapezoid floating module;
362 first long side tube;
364 first bar;
380 second trapezoid floating module;
382 second long side tube;
384 second bar;
400 floating platform;
402 first fastener;
404 second fastener;
406 third fastener;
408 fourth fastener;
410 fifth fastener;
412 sixth fastener;
414 seventh fastener;
415 eighth fastener;
416 ninth fastener;
417 tenth fastener;
418 eleventh fastener;
419 twelfth fastener;
420 central floating module;
422 first central tube;
423 second central tube;
424 third central tube;
425 fourth central tube;
426 fifth central tube;
427 sixth central tube;
430 first peripheral floating module;
432 first inner side tube;
434 first left side tube;
436 first right side tube;
440 second peripheral floating module;
442 second inner side tube;
444 second right side tube;
450 third peripheral floating module;
452 third inner side tube;
460 fourth peripheral floating module;
462 fourth inner side tube;
470 fifth peripheral floating module;
472 fifth inner side tube;
480 sixth peripheral floating module;
482 sixth inner side tube;
484 sixth left side tube;
490 solar panels;
492 imaginary central point;
500 offshore system;
510 solar panel;
520 wind turbine;
530 damping matts;
532 gaps;
534 middle portion;
536 first end;
538 second end;
540 tracking device;
550 first side tube;
560 second side tube;
570 first elbow;
580 second elbow;
590 fastening bond;

The invention claimed is:

1. A floating module, comprising:

an external frame having a plurality of side tubes for providing buoyance to the floating module;

an internal frame coupled to the external frame, wherein a facility is configured to mount on the internal frame; and a mooring mechanism coupled to the external frame or internal frame for fixing the floating module in position, wherein the mooring mechanism comprises:

at least one string comprising a plurality of elastic branch strings secured at the external frame; and a sinker coupled to the elastic branch strings and configured to be submerged under the sea for fixing the floating module at a specific location on the sea;

wherein the elastic branch strings are configured to remain under constant tension with no slack to enhance stability of the floating module at the sea and to make the floating module adaptable to harsh offshore conditions.

2. The floating module of claim 1, wherein the plurality of side tubes are hermitically joined for preventing leakage into the external frame.

3. The floating module of claim 1, wherein the internal frame has a H-shaped configuration comprising a first bar and a second bar coupled to the external frame; and a panel coupled to the first bar and the second bar, wherein the first bar and the second bar have a same length and are configured to be parallel to each other.

4. The floating module of claim 1, wherein:

the at least one string coupled to the external frame at a first end; and the sinker coupled to the at least one string at a second end opposed to the first end;

wherein, in a moored configuration, the sinker is submerged and suspended in a water column such that the sinker is spaced apart from seabed with a clearance above the seabed, and the at least one string is maintained in tension.

5. A floating platform, comprising:

at least two floating modules of claim 1, wherein the at least two floating modules are flexibly joined together.

6. The floating platform of claim 5, wherein the at least two floating modules are joined by thermoplastic welding.

7. The floating platform of claim 5, further comprising:

a plurality of dampers for flexibly coupling two side tubes of adjacent floating modules, respectively.

8. The floating platform of claim 5, further comprising:

at least one bumper between two of the plurality of dampers for preventing sliding of the plurality of dampers.

9. The floating platform of claim 5, wherein the floating platform is assembled by seven hexagonal floating modules that comprises one hexagonal floating module at a central position of the floating platform; and six hexagonal floating modules assembled surrounding the hexagonal floating module at the central position.

10. The floating platform of claim 5, further comprising:

a mooring mechanism coupled to the floating module at the central position of the floating platform.

11. The floating platform of claim 10, wherein the mooring mechanism comprises a central sinker coupled underneath to the central floating module.

12. An offshore system for harvesting renewable energy in a large water body, comprising:

a plurality of the floating platforms of claim 5, wherein the floating platforms are flexibly joined together; and wherein the large water is a sea or an ocean.

13. The offshore system of claim 12, wherein the plurality of floating platforms are configured to form at least one interior water region bound within the offshore system communicative with the large water body.

14. The offshore system of claim 12, comprising:

a plurality of solar panels mounted on the floating platforms for harvesting and converting solar energy to electrical energy.

15. The offshore system of claim 12, comprising:

a plurality of wind turbines mounted on the floating platforms for harvesting and converting wind energy to electrical energy.

16. The offshore system of claim 12, further comprising:

at least one combiner box for combining the electrical energy from the solar panels.

17. The offshore system of claim 16, further comprising:

a central inverter for changing electricity Direct Current (DC) to Alternating Current (AC).

18. The offshore system of claim 17, further comprising:

a transformer for transmitting and interconnecting the Alternative Current with a power grid.

19. The offshore system of claim 12, further comprising:

a dock for loading and unloading the offshore system with a ship.

20. The floating module of claim 2, wherein the hermetically sealed side tubes are sealed at both ends with stoppers, the stoppers being slightly smaller than the inner diameter of the side tube, or slightly larger than the outer diameter of the side tube.

21. The floating module of claim 20, wherein the stoppers are secured to the side tubes by joining methods selected from the group consisting of adhesive bonding, welding, mechanical fasteners, or fusion bonding, depending on the materials of the stoppers and side tubes.

22. The floating module of claim 1, wherein the at least one string further comprises a trunk string coupled between the branch strings and the sinker, such that loads from the branch strings are combined and transmitted to the sinker.

23. The floating module of claim 22, further comprising a shock-absorbing component coupled to the trunk string and configured to absorb shock and vibration energy transferred from the floating module through the mooring mechanism.

24. The floating platform of claim 5, wherein the floating platform is arranged in a star-shaped or flower-shaped configuration including one hexagonal floating module at a central position and six hexagonal floating modules assembled surrounding the central floating module, such that the floating platform is substantially symmetric about an imaginary central point to balance loads applied to the floating platform.

25. The floating platform of claim 10, wherein the mooring mechanism is coupled to the floating module at the central position such that a pulling force is distributed substantially evenly across the floating platform to reduce lateral and vertical movement of the floating platform.

26. The offshore system of claim 12, further comprising a plurality of damping mats coupling neighboring floating platforms, the damping mats being configured to absorb external shock and vibration and to provide walkable surfaces for inspection and maintenance.

27. The offshore system of claim 26, wherein each damping mat has a length sufficient to substantially cover at least a portion of a side tube, thereby providing access around the offshore system for inspection and maintenance.

* * * * *